US009114904B2

(12) United States Patent
Scanzillo et al.

(10) Patent No.: US 9,114,904 B2
(45) **Date of Patent: *Aug. 25, 2015**

(54) STACKABLE DISPLAY CONTAINER WITH BOX PORTION AND REINFORCING LAYER

(71) Applicant: S & D GROUP, LLC, Upper Saddle River, NJ (US)

(72) Inventors: Lawrence P. Scanzillo, Upper Saddle River, NJ (US); Silvio DiMarchi, Teaneck, NJ (US)

(73) Assignee: S & D Group, LLC, Upper Saddle River, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/087,191

(22) Filed: Nov. 22, 2013

(65) Prior Publication Data

US 2014/0076762 A1 Mar. 20, 2014

Related U.S. Application Data

(62) Division of application No. 13/393,096, filed as application No. PCT/US2010/047973 on Sep. 7, 2010, now Pat. No. 8,602,212.

(60) Provisional application No. 61/350,739, filed on Jun. 2, 2010, provisional application No. 61/323,399, filed on Apr. 13, 2010, provisional application No. 61/239,939, filed on Sep. 4, 2009.

(51) Int. Cl.
*B65D 5/32* (2006.01)
*B65D 5/00* (2006.01)
(Continued)

(52) U.S. Cl.
CPC ..... *B65D 5/321* (2013.01); *B65D 5/001* (2013.01); *B65D 5/002* (2013.01); *B65D 5/326* (2013.01);
(Continued)

(58) Field of Classification Search
CPC ..... B65D 5/001; B65D 5/002; B65D 5/321; B65D 5/326; B65D 5/3621; B65D 5/445; B65D 5/4608; B65D 5/4802; B65D 5/48024; B65D 5/48046; B65D 5/68; B65D 15/22; B65D 71/0096; B65D 71/50; B65D 77/0426
USPC ..... 206/509, 512, 769–774; 229/109, 229/120.18, 122.27, 122.32, 122.33, 191, 229/199, 918
See application file for complete search history.

(56) References Cited

U.S. PATENT DOCUMENTS 1,974,527 A 5/1932 Bliss
2,311,040 A 4/1941 Evert et al.
(Continued)

FOREIGN PATENT DOCUMENTS

JP 09-066928 A 3/1997
JP 2000-085846 A1 3/2000
(Continued)

*Primary Examiner* — Bryon Gehman
(74) *Attorney, Agent, or Firm* — Hoffmann & Baron, LLP

(57) ABSTRACT

A display container is provided herein which includes a box portion having a base portion, spaced-apart upstanding first and second end panels, and spaced-apart upstanding first and second edge panels extending from the base portion. The first and second edge panels are located between the first and second end panels, and the first edge panel extends a lesser distance from the base portion than the first end panel and the second end panel. The display container also includes a reinforcing layer which may be formed of a material stronger in shear than the material of the box portion. Advantageously, with the subject invention, a display container may be formed which has greater strength both for product containment and stacking as compared to the prior art.

16 Claims, 37 Drawing Sheets

(51) Int. Cl.

| | |
|---|---|
| ***B65D 5/36*** | (2006.01) |
| ***B65D 5/44*** | (2006.01) |
| ***B65D 5/468*** | (2006.01) |
| ***B65D 5/489*** | (2006.01) |
| ***B65D 5/49*** | (2006.01) |
| ***B65D 5/68*** | (2006.01) |
| ***B65D 8/00*** | (2006.01) |
| ***B65D 71/00*** | (2006.01) |
| ***B65D 71/50*** | (2006.01) |
| ***B65D 77/04*** | (2006.01) |

(52) U.S. Cl.

CPC ..... *B65D 5/3621* (2013.01); *B65D 5/445* (2013.01); *B65D 5/4608* (2013.01); *B65D 5/4802* (2013.01); *B65D 5/48024* (2013.01); *B65D 5/48046* (2013.01); *B65D 5/68* (2013.01); *B65D 15/22* (2013.01); *B65D 71/0096* (2013.01); *B65D 71/50* (2013.01); *B65D 77/0426* (2013.01)

(56) References Cited

U.S. PATENT DOCUMENTS

| | | | | |
|---|---|---|---|---|
| 2,567,832 | A | 9/1951 | Vadner | |
| 2,746,668 | A | 5/1956 | Ringel et al. | |
| 3,598,233 | A | 8/1971 | Jasinover | |
| 3,918,576 | A | 11/1975 | Taub | |
| 3,935,943 | A | 2/1976 | Meyer et al. | |
| 3,995,736 | A | 12/1976 | Lawson et al. | |
| 4,105,153 | A * | 8/1978 | Locke | 229/109 |
| 4,613,045 | A * | 9/1986 | Watson | 206/512 |
| 4,709,852 | A | 12/1987 | Stoll | |
| 4,925,087 | A | 5/1990 | Ostrander | |
| 5,039,002 | A | 8/1991 | Spamer | |
| 5,323,896 | A | 6/1994 | Jones | |
| 5,372,299 | A | 12/1994 | Edgerton, Jr. et al. | |
| 5,562,246 | A | 10/1996 | Smith et al. | |
| 5,950,911 | A | 9/1999 | Naughton et al. | |
| 5,967,406 | A | 10/1999 | Moorman | |
| 5,975,413 | A | 11/1999 | Moen | |
| 5,992,735 | A * | 11/1999 | Oosterbaan | 229/191 |
| 6,328,202 | B1 | 12/2001 | Giblin | |
| 6,352,199 | B1 | 3/2002 | Gardner | |
| 6,378,764 | B1 * | 4/2002 | Teixidor Casanovas | 229/191 |
| 6,419,090 | B1 | 7/2002 | Focke et al. | |
| 6,454,107 | B1 | 9/2002 | Belanger et al. | |
| 6,520,898 | B1 | 2/2003 | Moen | |
| 6,719,191 | B1 | 4/2004 | Christensen et al. | |
| 6,986,457 | B2 | 1/2006 | O'Connell et al. | |
| 7,258,265 | B2 | 8/2007 | Loew | |
| 7,472,819 | B1 | 1/2009 | Wachter | |
| 7,473,215 | B2 | 1/2009 | Moen | |
| 7,487,905 | B2 | 2/2009 | McClure | |
| 7,607,566 | B2 | 10/2009 | Phillips et al. | |
| 7,819,305 | B2 * | 10/2010 | Little | 229/122.32 |
| 7,922,069 | B2 * | 4/2011 | Gardner | 229/109 |
| 8,292,082 | B2 | 10/2012 | Bowman | |
| 8,690,048 | B2 * | 4/2014 | Philips et al. | 229/199 |
| 2007/0228127 | A1 | 10/2007 | Gardner | |
| 2008/0000955 | A1 | 1/2008 | Phan | |
| 2008/0314794 | A1 | 12/2008 | Bowman | |
| 2009/0223857 | A1 | 9/2009 | Bowman | |
| 2010/0006456 | A1 | 1/2010 | Bevier | |
| 2010/0083618 | A1 | 4/2010 | Little | |
| 2010/0087304 | A1 | 4/2010 | Little | |

FOREIGN PATENT DOCUMENTS

| | | | |
|---|---|---|---|
| JP | 2008-001396 | A | 1/2008 |
| WO | WO 2004043796 | A1 * | 5/2004 |
| WO | WO 2009024625 | A1 * | 2/2009 |

* cited by examiner

STACKABLE DISPLAY CONTAINER WITH BOX PORTION AND REINFORCING LAYER

CROSS-REFERENCES TO RELATED APPLICATIONS

This application is a divisional application of U.S. application Ser. No. 13/393,096, filed Feb. 28, 2012, now U.S. Pat. No. 8,602,212, which is a National Stage Application under 35 U.S.C. §371 of PCT International Application No. PCT/US2010/047973, filed Sep. 7, 2010, which claims priority to U.S. Provisional Application No. 61/350,739, filed Jun. 2, 2010, U.S. Provisional Application No. 61/323,399, filed Apr. 13, 2010, and U.S. Provisional Application No. 61/239,939, filed Sep. 4, 2009, these disclosures being incorporated herein in their respective entireties.

FIELD OF THE INVENTION

This invention relates to display and shipping containers and, more particularly, to stackable display and shipping containers.

BACKGROUND OF THE INVENTION

Display containers are known in the prior art. In particular, display containers known as "club trays" are commonly used in wholesale or other shopping clubs where product is presented at point-of-sale in its shipping container. Other types of display containers are known, such as "PDQ" and "counter displays" which are used for rack or counter placement, particularly in supermarkets, drug stores, and other mass merchants. The display containers are formed of paperboard and have one or two sides open to allow product removal therefrom. The common display container design, however, has limitations in strength. The lack of inherent strength not only limits the permissible weight to be supported by each display container, but, also, limits the stackable number of units.

In addition, typical prior art display containers are formed from single paperboard blanks at a vendor's facility prior to packing and shipping. To form a display container, the paperboard blank must be cut to size and shape of the desired container. Fold lines and openings are put into the paperboard blank and are known as scores, slots, slits, perfs, cuts, etc., to accomplish this. The scores, slots, slits, perfs, cuts, etc., that are added weaken the blank but this is necessary to allow the blank to be formed into the container. In many cases, the blank is also decorated in addition to having it die cut to shape and size. Both of these operations further stress the paperboard by weakening and crushing the paperboard fibers and fluting. With paperboard providing inherently limited strength and with the additional weakening through die cutting and decoration, to maximize its integrity as a container, the blank must now be assembled to its desired form. Assembly consists of breaking blank scores, perfs, cuts, etc. and to begin folding the blank to form the final shape of the container. The time and effort needed to attain the final shape determines the labor handling cost.

SUMMARY OF THE INVENTION

A display container is provided herein which includes a box portion having a base portion, spaced-apart upstanding first and second end panels, and spaced-apart upstanding first and second edge panels extending from the base portion. The first and second edge panels are located between the first and second end panels, and the first edge panel extends a lesser distance from the base portion than the first end panel and the second end panel. The display container also includes a reinforcing layer having a first panel disposed to overlap at least portions of the base portion, a second panel disposed adjacent to the first end panel in face-to-face engagement, and a third panel disposed adjacent to the second end panel in face-to-face engagement. The reinforcing layer is formed of a material stronger in shear than the material of the box portion. Advantageously, with the subject invention, a display container may be formed which has greater strength both for product containment and stacking as compared to the prior art.

These and other features of the subject invention will be better understood through a study of the following detailed description and accompanying drawings.

DETAILED DESCRIPTION OF THE INVENTION

Figure 1:
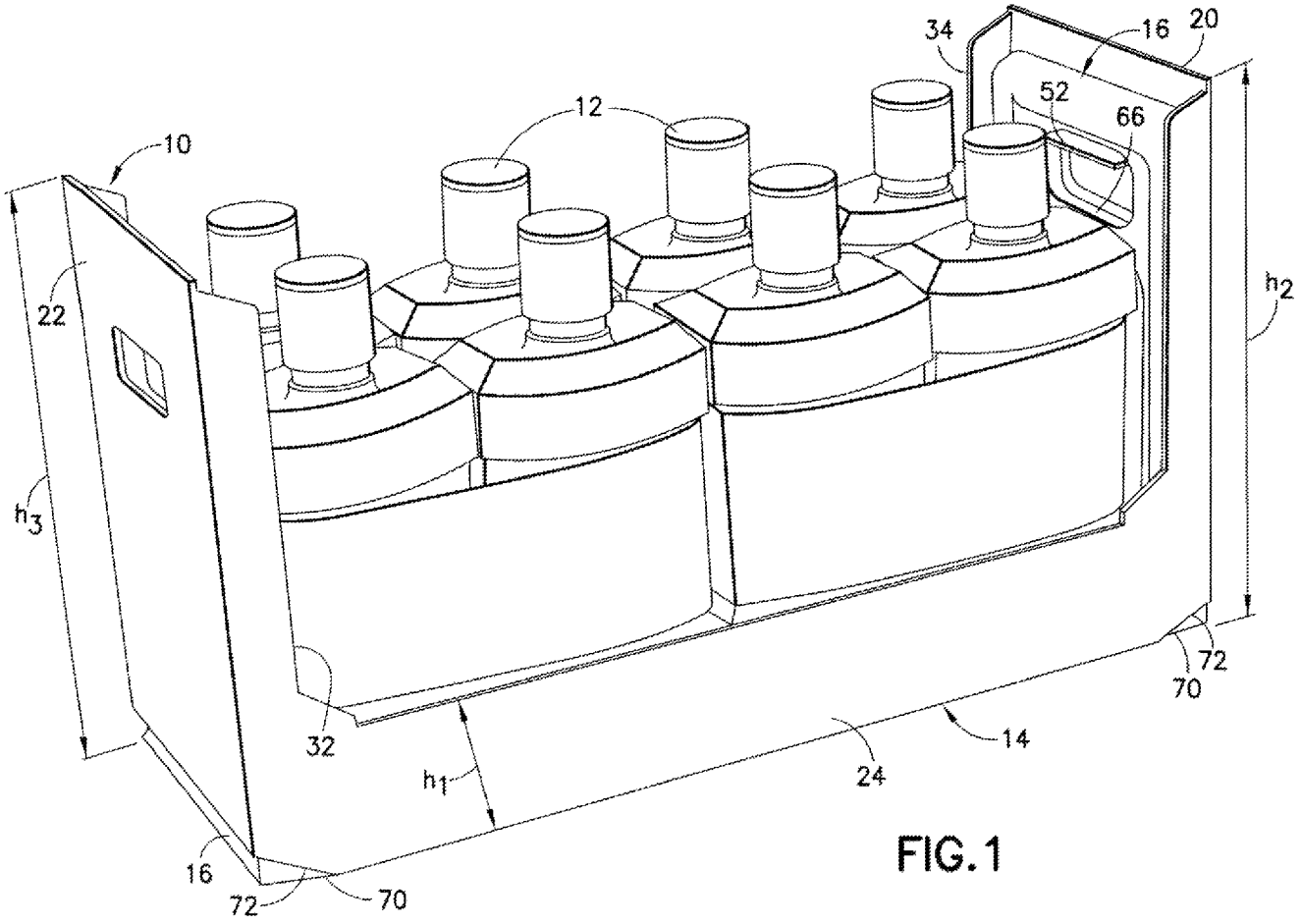
FIG. 1 is a perspective view of a display container formed in accordance with the subject invention.

With reference to the figures, a display container is shown and generally designated with the reference numeral 10. The display container 10 may be used for shipping product 12, such as bottles, and/or displaying the product 12 at a point-of-sale. As will be appreciated by those skilled in the art, the display container 10 may be formed of various sizes to accommodate the product 12 of different sizes and shapes.

Figure 5:
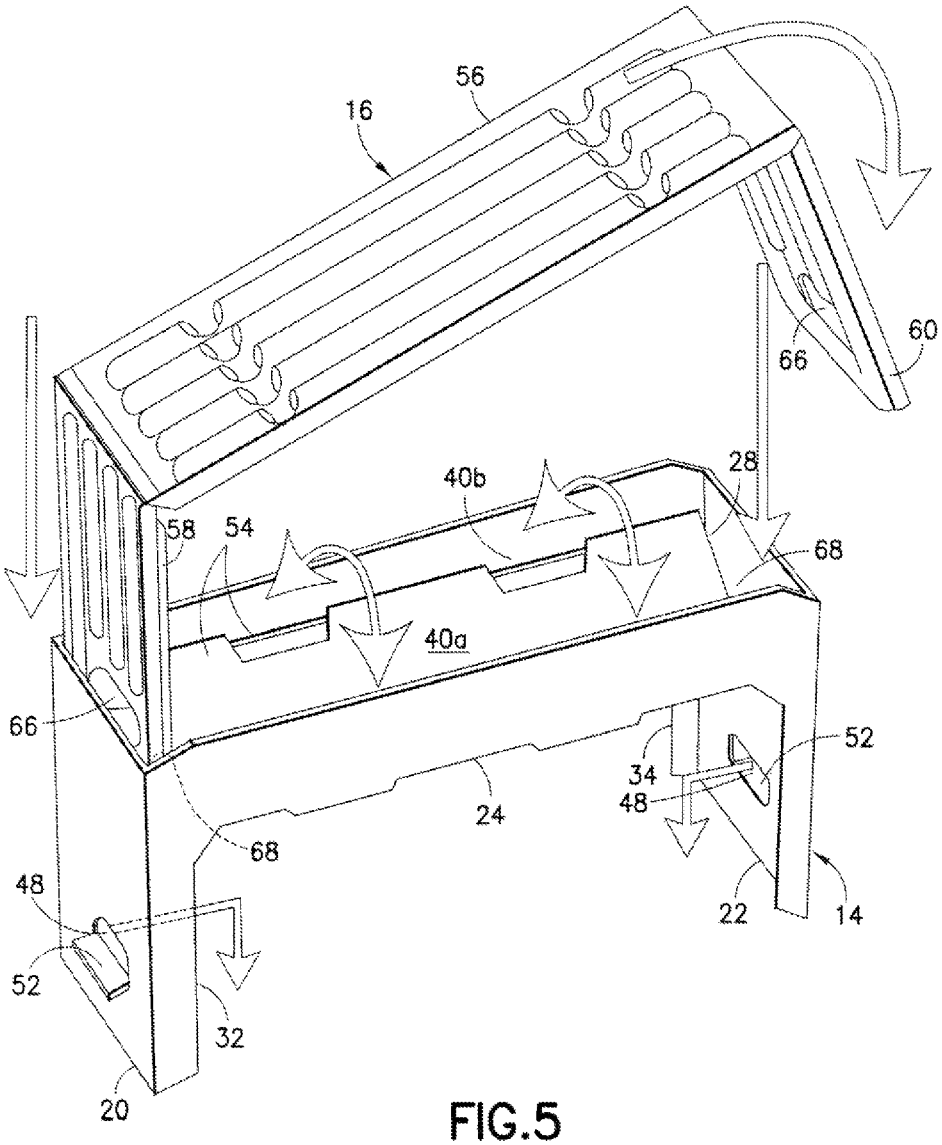
FIG. 5 shows a possible method of assembly of the subject invention.
Figure 6:
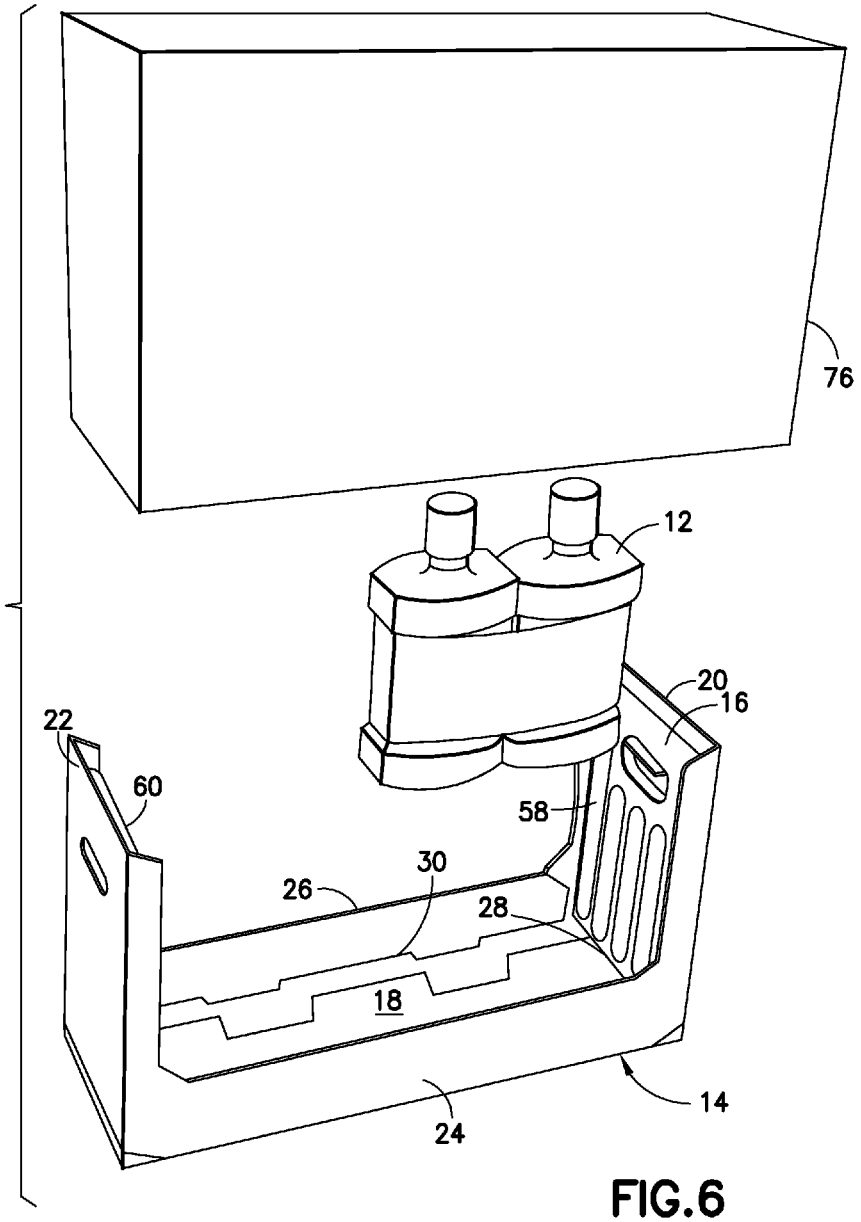
FIG. 6 shows a shipping carton usable with the subject invention.

The display container 10 generally includes a box portion 14 and a reinforcing layer 16. As shown in FIGS. 1, 5 and 6, the box portion 14 includes a base portion 18 with spaced-apart first and second end panels 20, 22 extending from the base portion 18. The first and second end panels 20, 22 are upstanding in the assembled configuration of the display container 10 (FIG. 1). The box portion 14 also includes first and second edge panels 24, 26 which are spaced-apart and located between the first and second end panels 20, 22. The first and second edge panels 24, 26 extend from the base portion 18 and are upstanding with the display container 10 being in an assembled configuration. In a preferred embodiment, the first and second end panels 20, 22 and the first and second edge panels 24, 26 completely bound the base portion 18. In addition, it is preferred that the base portion 18 have a generally rectangular shape with the first and second edge panels 24, 26 having longer length than the first and second end panels 20, 22. The first and second end panels 20, 22 are preferably disposed at, or beyond, opposite ends 28 of the base portion 14 while the first and second edge panels 24, 26 are disposed along opposite edges 30 of the base portion 18. It is further preferred that the first and second end panels 20, 22 be generally parallel and that the first and second edge panels 24, 26 be generally parallel. The base portion 18, the first end panel 20, the second end panel 22, the first edge panel 24 and/or the second edge panel 26 may be formed from one component or two or more assembled components.

Figure 33:
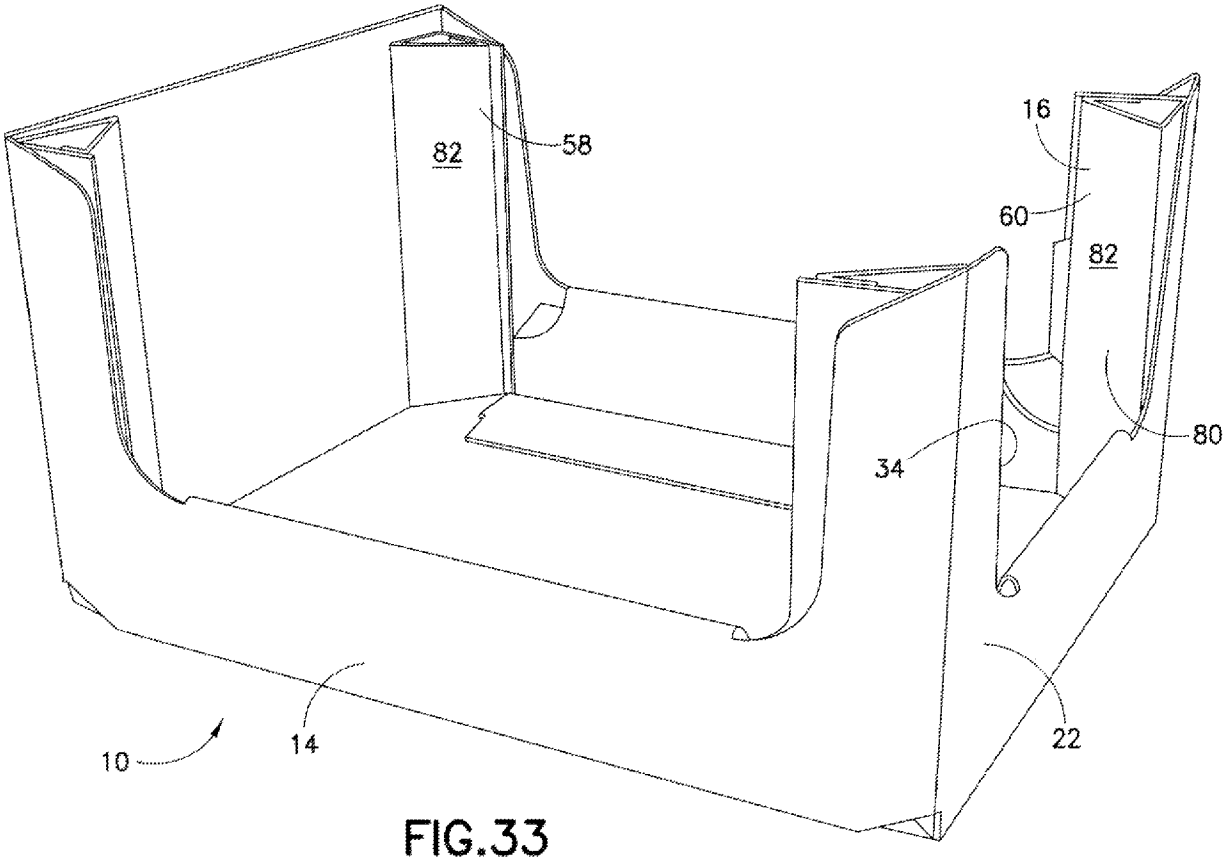
Figure 34:
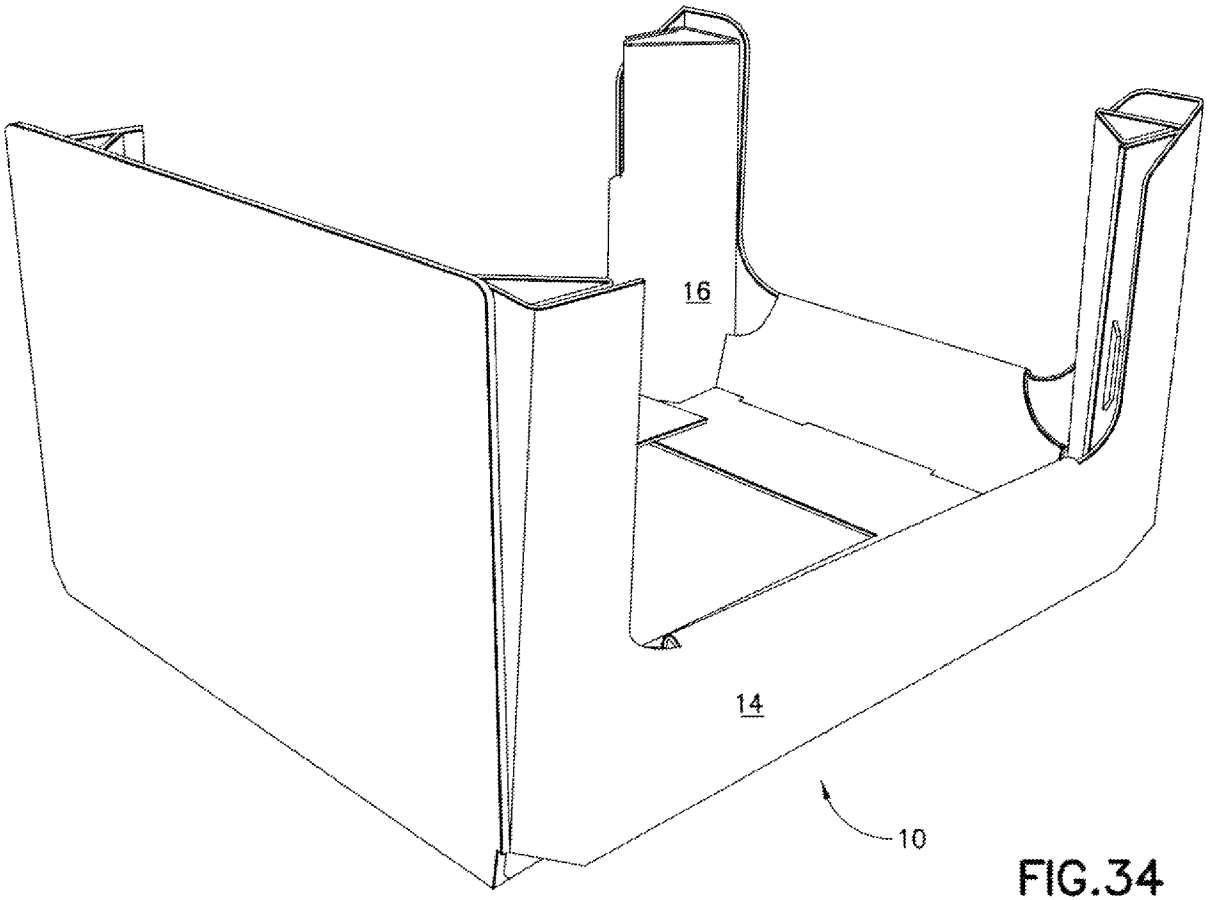
Figure 35:
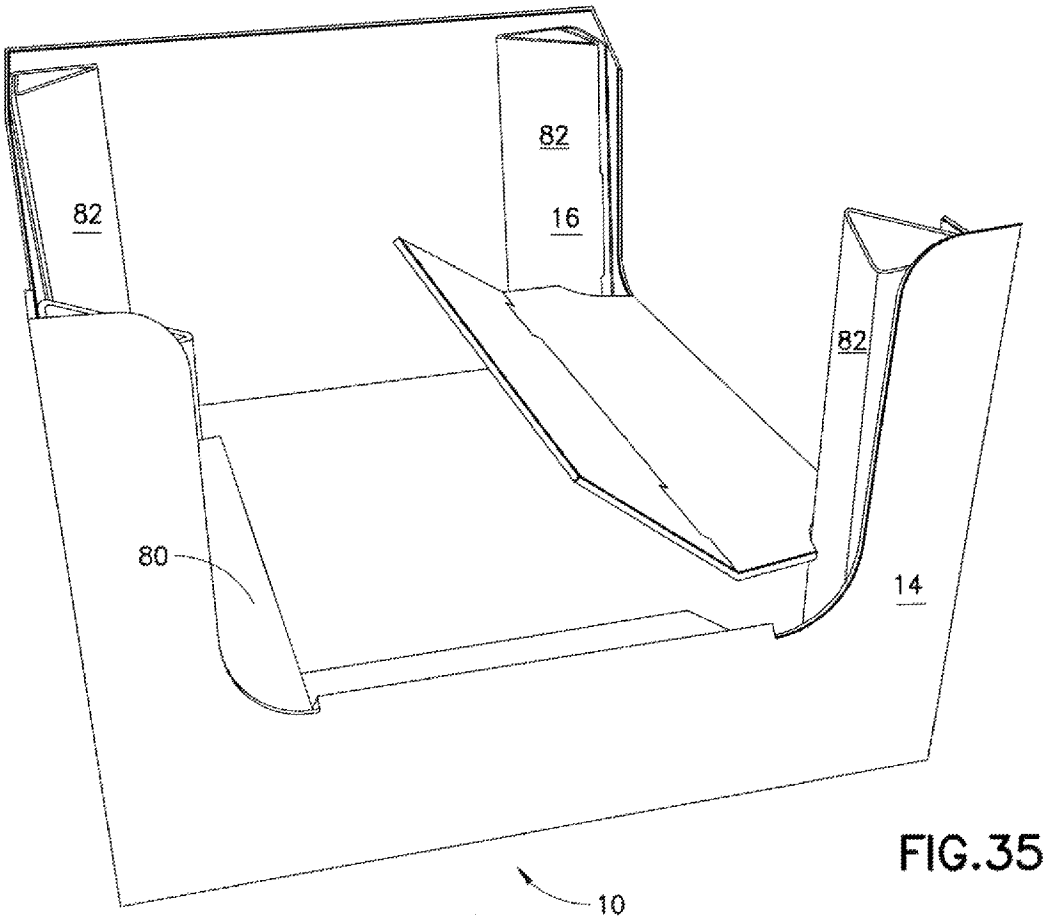
Figure 36:
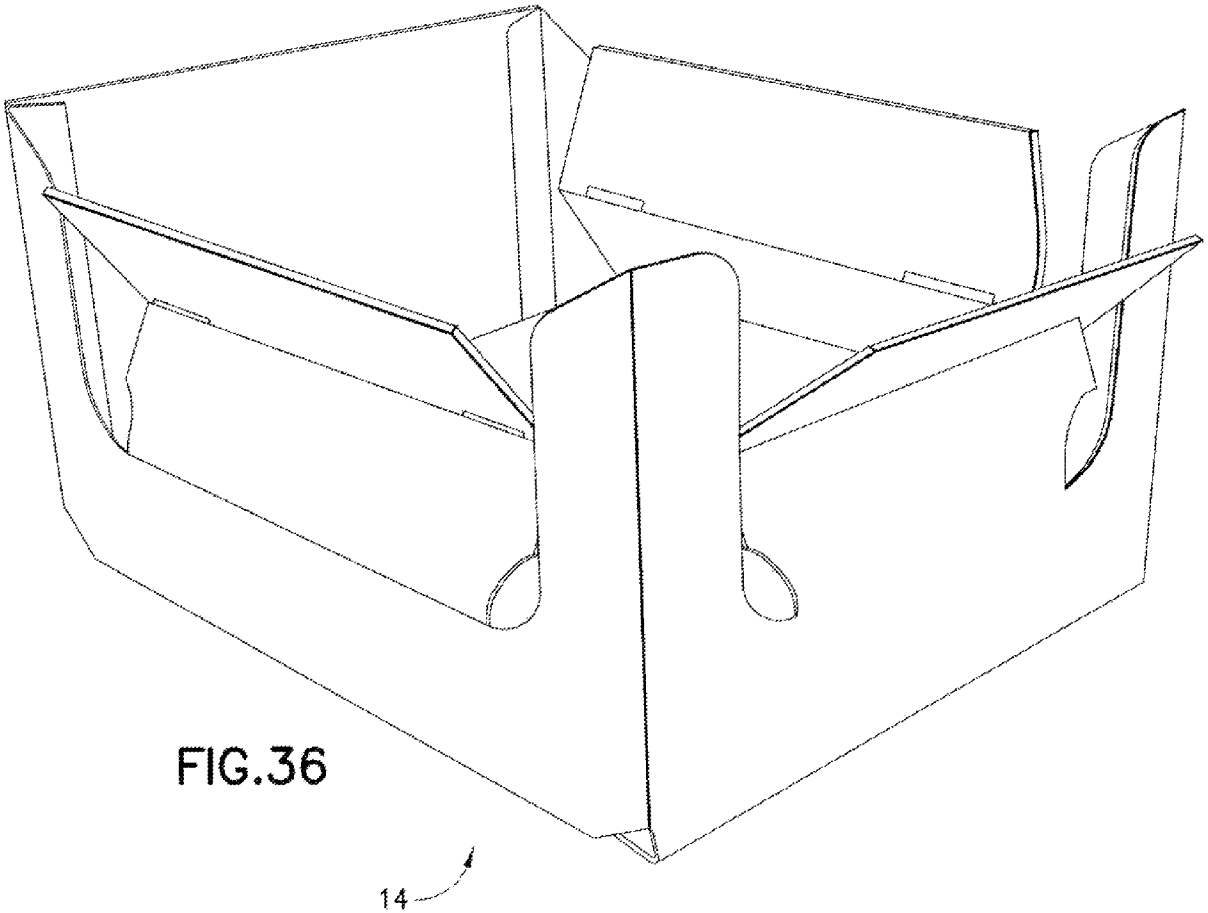
Figure 37:
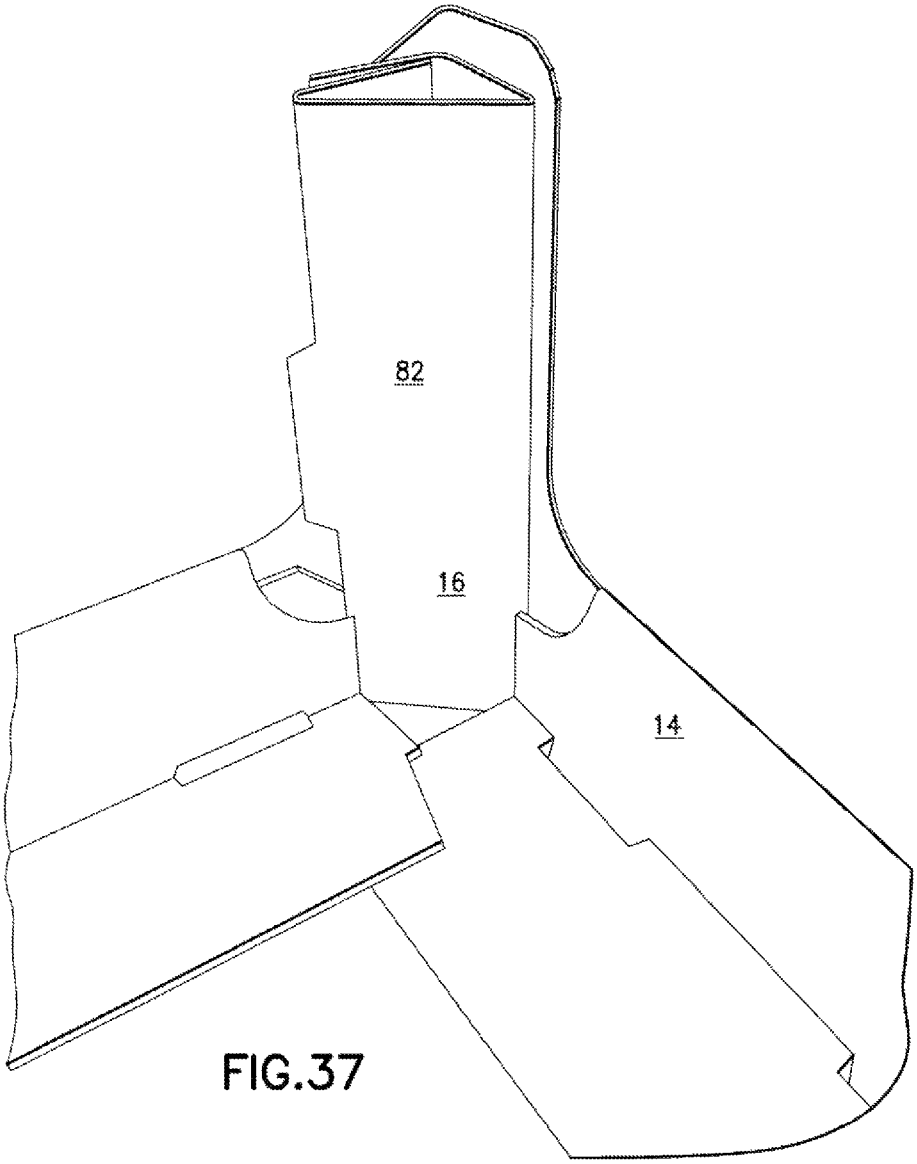
Figure 38:
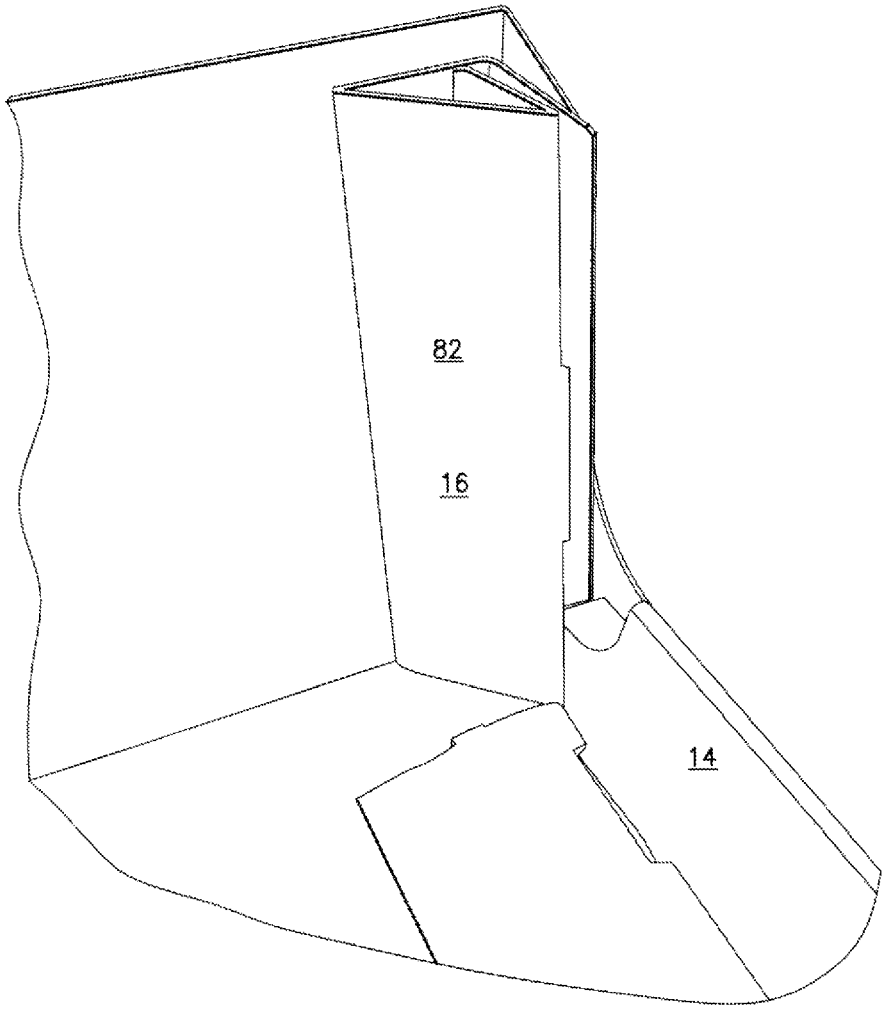

The product 12 is packed into the display container 10 above the base portion 18 and within the first and second end panels 20, 22 and within the first and second edge panels 24, 26. As shown in FIG. 1, it is preferred that the first edge panel 24 have a lesser height h1 from the base portion 18 than the height h2 of the first end panel 20 or the height h3 of the second end panel 22. In this manner, a window 32 is defined above the first edge panel 24 and between the first and second end panels 20, 22 which provides access to the product 12 contained in the display container 10. The second edge panel 26 may be likewise formed with a lesser height than the first and second end panels 20, 22 thus defining a secondary window 34. The window 32 and the secondary window 34 provide simultaneous access from both sides of the display container 10 to the product 12. The first and second edge panels 24, 26 may be formed of varying heights and configurations along the respective lengths thereof such that the window 32 and the secondary window 34 may be optionally formed with different shapes and configurations, such as being formed partially or entirely polygonal, arcuate and/or irregular. Patterns or other design elements may be also formed along the first edge panel 24 and/or the second edge panel 26. Optionally, the first and/or second end panel 20, 22 may include a secondary window 34 (e.g., as shown in FIG. 33).

Preferably, the box portion 14 is formed from a unitary blank, more preferably formed of paperboard. The paperboard may be cardboard, such as corrugated cardboard. As used herein, paperboard may cover corrugated and non-corrugated boards, particularly cellulosic boards, including, but not limited to, fluted corrugated board, which can be produced in varying grades (e.g., B-, C-, E-Flute). The paperboards may be of various burst designations (e.g., 200 lb.-, 250 lb.-test). Also, the paperboard may be of various constructions (e.g., single, double, multi-wall constructions).

Figure 2:
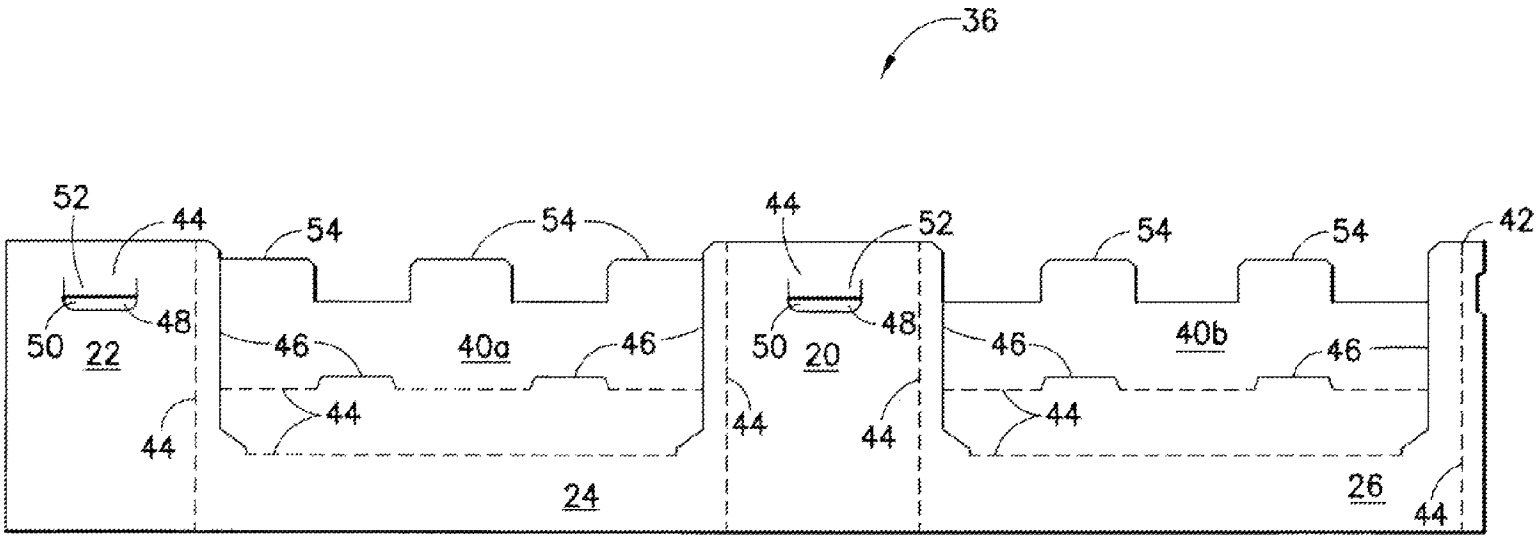
FIGS. 2 and 3 show possible blanks usable for forming the box portion of the subject invention.
Figure 3:
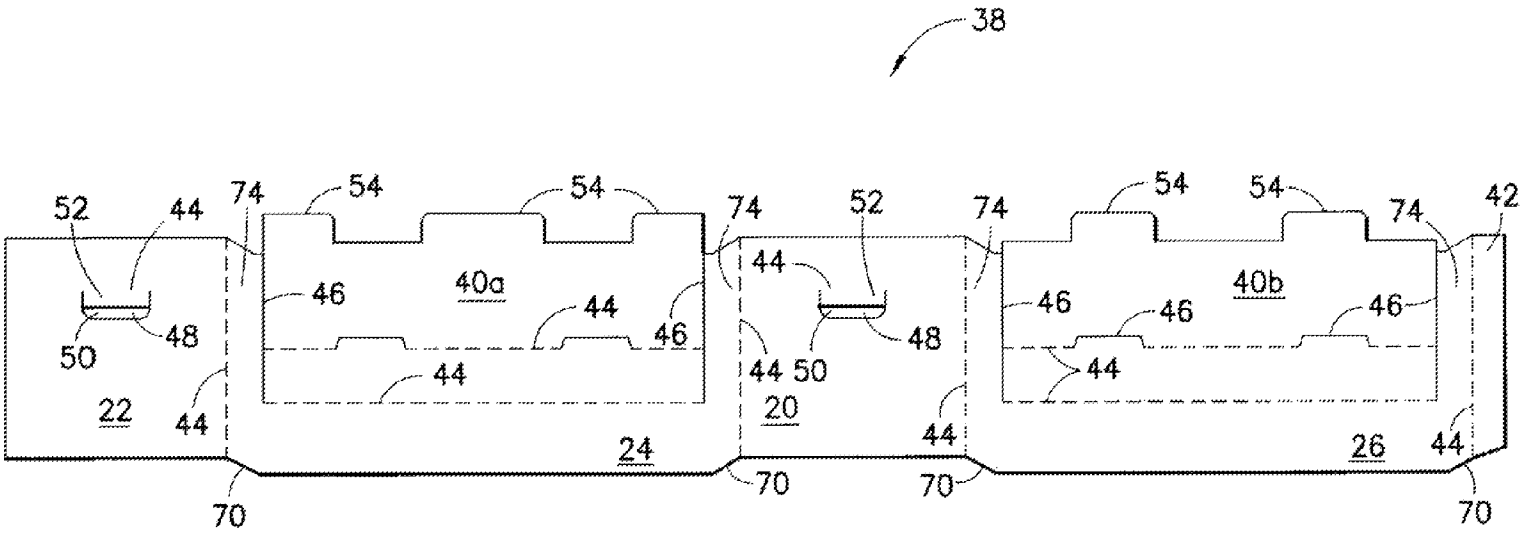

FIGS. 2 and 3 depict blanks 36, 38 which are usable to form the box portion 14. With reference to FIG. 2, the blank 36 is preferably a unitary die-cut piece of paperboard having defined therein the first and second end panels 20, 22 and the first and second edge panels 24, 26. The base portion 18 is formed by cooperating base panels 40*a*, 40*b*. Connecting edge 42 is provided at one end of the blank 36. Fold lines 44 are provided to facilitate assembly of the blank 36 into the box portion 14. As will be appreciated by those skilled in the art, the fold lines 44 may be scored lines, perforated lines, or other lines of weakness. The panels 20, 22, 40*a*, 40*b* are partially separated from surrounding portions by cut lines 46 which are preferably cut into the blank 36 when the blank 36 is die-cut. Preferably, hand holes 48 are formed in the first and second end panels 20, 22 so as to be in general alignment with one another with the box portion 14 being assembled. The hand holes 48 may be prepared by die-cutting and removing a slot 50 in the first and second end panels 20, 22 with an adjacent flap 52 being provided that is foldable along one of the corresponding of the fold lines 44.

Figure 4:
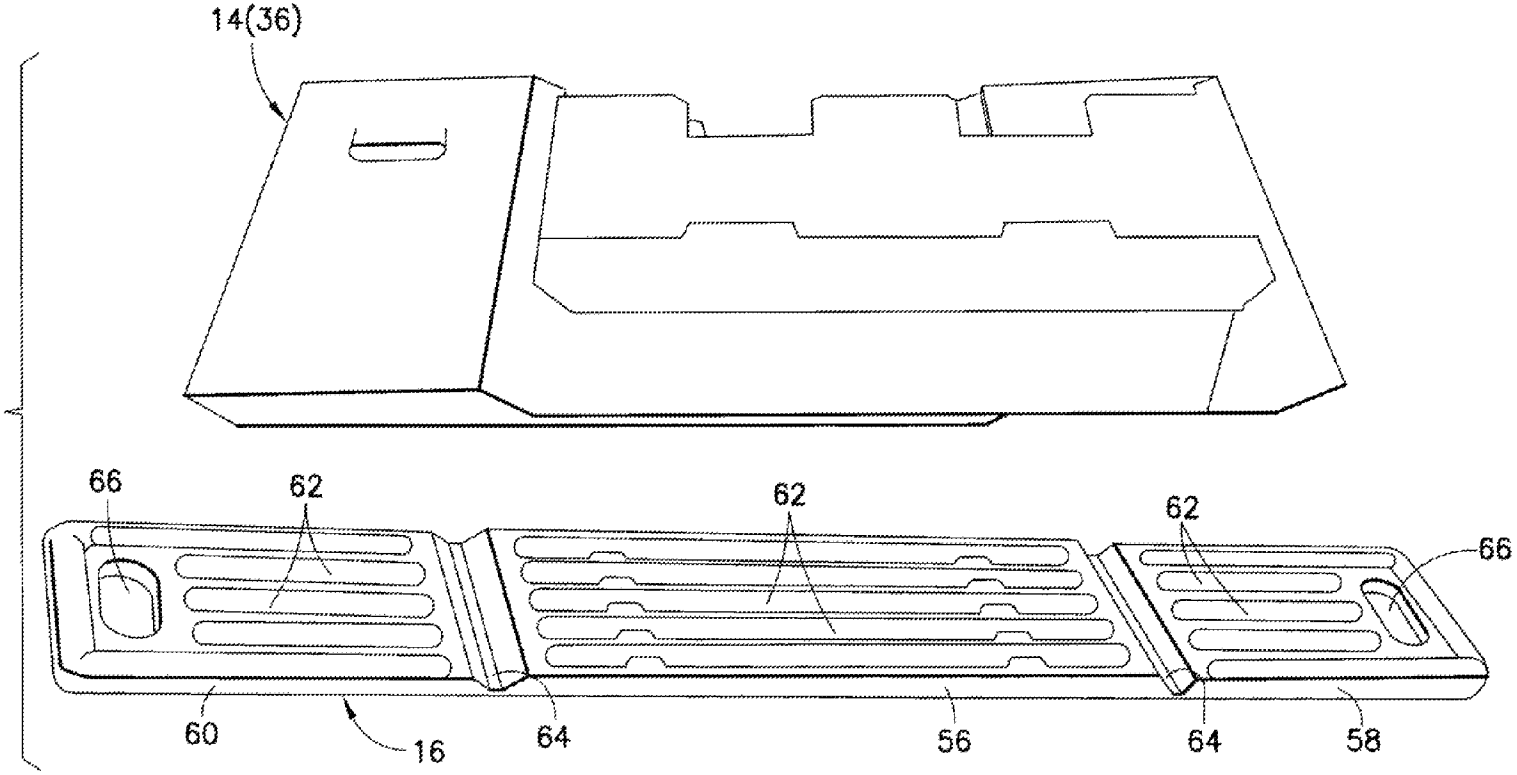
FIG. 4 shows a kit performing a display container in accordance with the subject invention.

With reference to FIG. 4, the blank 36 may be generally initially assembled by fastening the connecting edge 42 to the second end panel 22 and folding the blank 36 about the first end panel 20 so as to take the tubular configuration shown in FIG. 4. In this state, the blank 36 may be stored flat, ready for assembly. With reference to FIG. 5, the box portion 14 is prepared by expanding the blank 36 from the tubular configuration of FIG. 4 by folding inwardly the base panels 40*a*, 40*b* so as to form the base portion 18. Preferably, the base panels 40*a*, 40*b* are formed with interlocking fingers 54 which are interleaved upon assembly of the base portion 18 thus providing rigidity thereto.

As will be appreciated by those skilled in the art, the box portion 14 may be formed from blanks of various configurations and/or multiple blanks which are fastened together. The blank 38 of FIG. 3 is formed in similar fashion to the blank 36, but with different proportions and different shaped features.

With reference to FIG. 4, preferably, the reinforcing layer 16 includes a first panel 56, a second panel 58 and a third panel 60. Preferably, the reinforcing layer 16 is unitarily formed. Also, preferably the first panel 56, the second panel 58, and the third panel 60 are each planar. As shown in the figures, the reinforcing layer 16 is disposed adjacent to the box portion 14 such that the first panel 56 is disposed to overlap at least portions of the base portion 18, the second panel 58 is disposed adjacent to the first end panel 20 in face-to-face engagement, and the third panel 60 is disposed adjacent to the second end panel 22 in face-to-face engagement. The first panel 56 may be above the base portion 18 or vice versa. Also, the first panel 56 may be below the base portion 18 with one or more portions of the first panel 56 protruding, or being otherwise exposed by the base portion 18, so as to be viewable from the top of the container 10 (i.e., viewable through the first and second end panels 20, 22).

The material of the reinforcing layer 16 is stronger in shear than the material of the box portion 14. Accordingly, the reinforcing layer 16, particularly the first panel 56, may support a greater load across the face thereof than a panel of similar dimensions formed from the material of the box portion 14. As shown in FIGS. 1 and 6, it is preferred that the first and second end panels 20, 22 be located externally of the second and third panels 58, 60 and that the base portion 18 be located interiorly of (i.e., above) the first panel 56. In this manner, the first and second end panels 20, 22 provide outer surfaces for the container 10 for decorations, graphics or other indications. In addition, the base portion 18 provides a surface viewable to a user which may be adorned. To add additional rigidity to the reinforcing layer, ribs 62 may be formed in the reinforcing layer 16 which provide sections of greater thickness.

The reinforcing layer 16 may be formed of molded pulp (also known as molded fiber) which may be of any cellulosic material including recycled material. It is further preferred that the box portion 14 be formed of paperboard, more particularly cardboard, such as corrugated cardboard. The paperboard may be cardboard, such as corrugated cardboard. As used herein, paperboard may cover corrugated and non-corrugated boards, particularly, cellulosic boards, including, but not limited to, fluted corrugated board, which can be produced in varying grades (e.g., B-, C-, E-Flute). The paperboards may be of various burst designations (e.g., 200 lb.-, 250 lb.-test). Also, the paperboard may be of various constructions (e.g., single, double, multi-wall constructions). The paperboard may provide good quality surfaces for printing and/or decorations, such as, by die cutting, embossing, mounting of pre-printed sheets, hot stamping, and other known techniques.

The reinforcing layer 16 may be formed of materials other than molded pulp, but which are stronger in shear than the material of the box portion 14. For example, the reinforcing layer 16 may be formed of paperboard, thermoplastic, wood, metal, or combinations thereof. Molded pulp provides an advantage due to its recyclability. It is additionally noted that the reinforcing layer 16 may be formed of the same material as the box portion 14 but in different quantity or other configuration. For example, both the box portion 14 and the reinforcing layer 16 may be formed of paperboard, but with the reinforcing layer 16 being formed of double or other multi-wall constructed paperboard with the box portion 14 being formed of the same paperboard but in a single wall construction. With this arrangement, the reinforcing layer 16 would be stronger in shear than the box portion 14. Likewise, if the box portion 14 is provided as a double or other multi-wall constructed paperboard, the reinforcing layer 16 may be provided as the same paperboard but with a greater quantity of walls. Other parameters may be altered to provide the reinforcing layer 16 with more shear strength such as thickness, corrugation configuration and so forth. The box portion 14 and the reinforcing layer 16 may be both formed of paperboard, but of different types (e.g., different structures (e.g., fluted versus non-fluted), different designations and/or different constructions (e.g., single wall versus multi-wall)).

Figure 7:
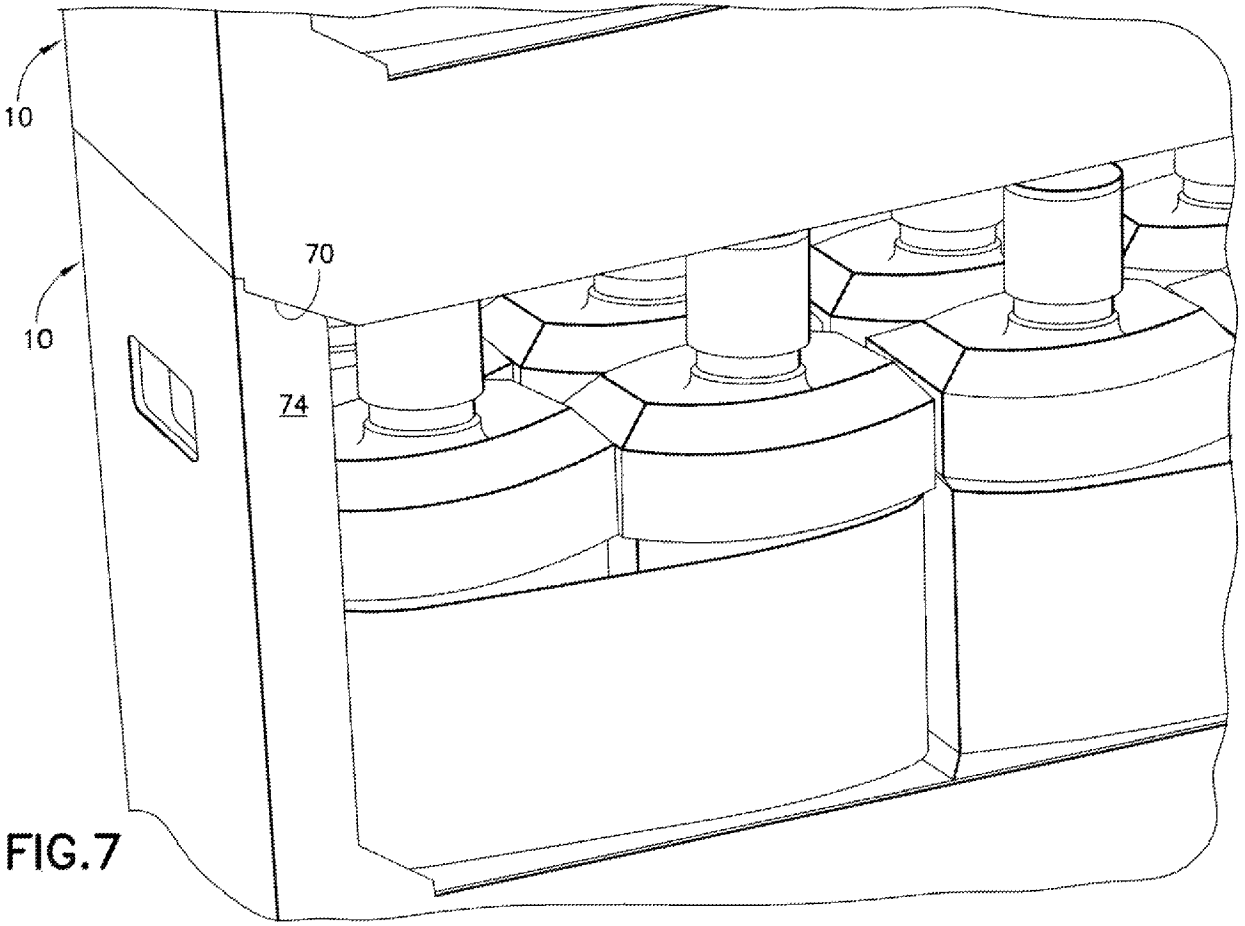
FIG. 7 shows two display containers formed in accordance with the subject invention in stacked arrangement.

Preferably, the first panel 56 is formed to generally the same dimensions as the base portion 18, and the second panel 58 and the third panel 60 may be generally formed to the dimensions of the first end panel 20 and the second end panel 22, respectively. As discussed below, the first and second end panels 20, 22 may be formed with slightly greater height than the second and third panels 58, 60, respectively, so as to facilitate interlocking in a stacked arrangement as discussed below. Optionally, as shown in FIG. 1, lower portions of the first and second end panels 20, 22 may be removed thus allowing axial registration of the first and second end panels 20, 22 of the display container 10 in a stacked arrangement. As shown in FIG. 7, the first and second end panels 20, 22 of the lower stacked display container 10 may overlap a portion of the upper stacked display container 10 with the stacked first end panels 20 and the stacked second end panels 22 abutting. This provides a stacked nesting arrangement.

The first panel 56 is preferably connected to the second panel 58 and to the third panel 60. In this manner, any load borne by the first panel 56 may be transmitted directly to the second and third panels 58, 60. In a preferred embodiment, the second panel 58 and the third panel 60 are articulatingly connected to the first panel 56. More preferably, living hinges 64 connect the second panel 58 to the first panel 56 and the third panel 60 to the first panel 56, preferably at opposite ends of the first panel 56. Other articulating connections may be provided. For example, the first panel 56, the second panel 58 and the third panel 60 may be separately formed with articulating connections being formed therebetween such as by taping the panels 56, 58, 60 together or providing a different hinged connection.

Preferably, the reinforcing layer 16 is connected to the box portion 14. In a preferred embodiment, secondary hand holes 66 are formed in the second and third panels 58, 60 configured to be aligned with the hand holes 48 of the first and second end panels 20, 22. In an assembled state, the flaps 52 adjacent the hand holes 48 may be bent and tucked into the secondary hand holes 66 as shown in FIG. 1. It is preferred that the flaps 52 be folded against the upper edge of the secondary hand holes 66. As will be appreciated by those skilled in the art, the reinforcing layer 16 may be connected to the box portion 14 through various modes of connection, including various mechanical interconnections and/or adherent connections (e.g., adhesive). In addition, or alternatively, connection may be provided with the base portion 18 being located above the first panel 56.

With reference to FIG. 5, a possible manner of assembling the display container 10 is depicted therein. In a first step, the box portion 14 is formed, such as from one of the prepared blanks 36, 38. Taking the prepared blank as shown in FIG. 4, the base panels 40*a*, 40*b* are caused to be folded inwardly thus causing the box portion 14 to be formed. The reinforcing layer 16 is then applied with the first panel 56 overlapping the base portion 18 (e.g., the first panel 56 is placed adjacent to the base portion 18 in face-to-face engagement), the second panel 58 being placed adjacent to the first end panel 20 in face-to-face engagement and the third panel 60 being placed adjacent to the second end panel 22 in face-to-face engagement. The second and third panels 58, 60 may be folded to facilitate assembly. It is preferred that open channels 68 be defined on both ends of the base portion 18 so that the second and third panels 58, 60 may be assembled from the bottom of the box portion 14 and through the open channels 68 as shown in FIG. 5. In a preferred embodiment, the reinforcing layer 16 is connected to the box portion 14 by bending the flaps 52 inwardly to nest within the secondary hand holes 66.

Figure 15:
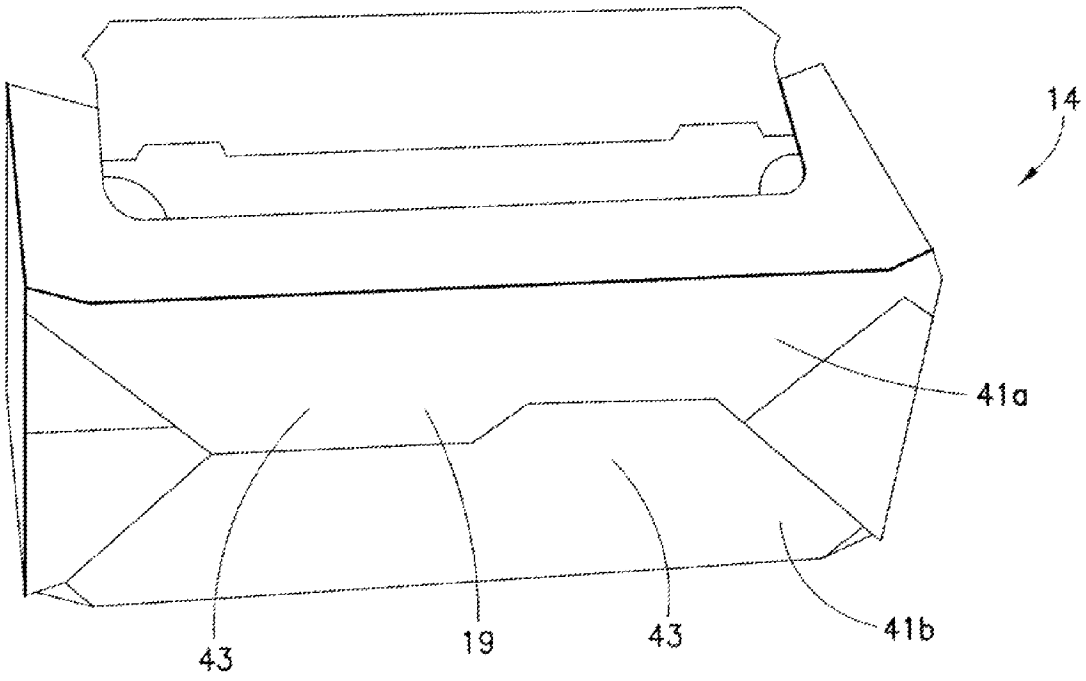
FIGS. 15-22 show a display container formed in accordance with the subject invention having a bottom portion and assembly thereof.
Figure 18:
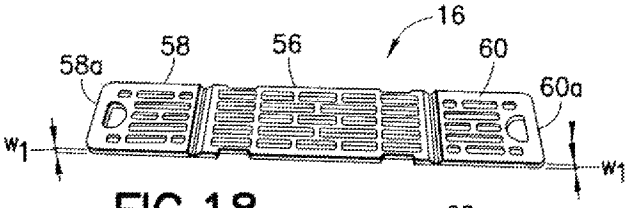
Figure 19:
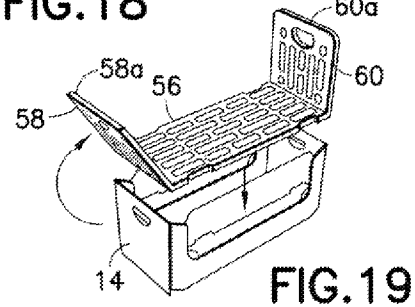
Figure 22:
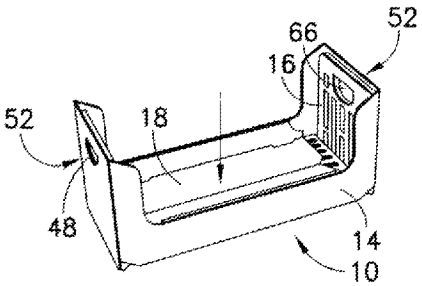
Figure 21:
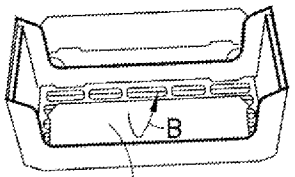

The box portion 14 may be formed open on the bottom such that the reinforcing layer 16, particularly the first panel 56, is partially or wholly exposed from below the container 10. With reference to FIG. 15, it is preferred that a bottom portion 19 be provided which extends across the bottom of the box portion 14 and covers the first panel 56 with the display container 10 being in an assembled state. In this manner, the first panel 56 is interposed between the base portion 18 and the bottom portion 19. The bottom portion 19 not only provides a larger resting surface which provides additional stability to the display container 10 in resting on the ground, the bottom portion 19 also covers the first panel 56 to provide a more aesthically-pleasing appearance to the display container 10. The first panel 56 need not be secured to the base portion 18 or to the bottom portion 19, although such securement, such as by adhesive and/or mechanical connection (e.g., stapling), may be provided.

Figure 26:
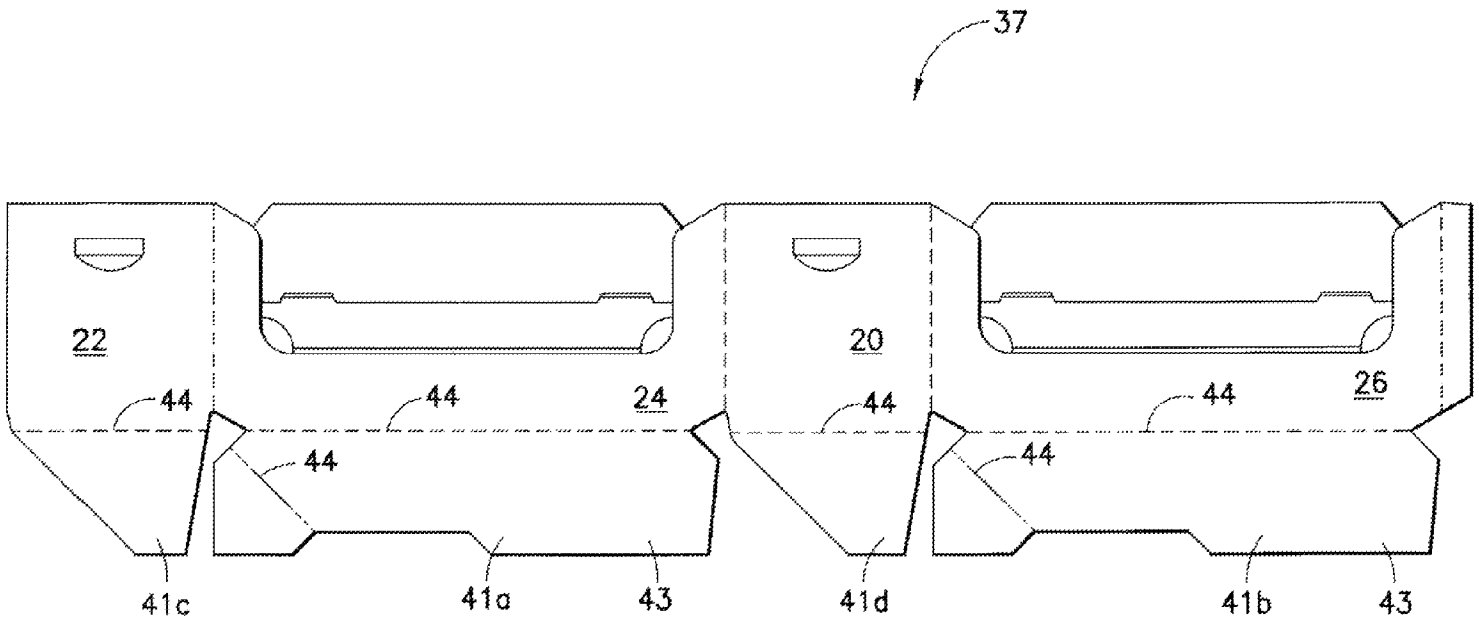
FIGS. 26 and 27 show possible blanks usable for forming the box portion of the subject invention.
Figure 27:
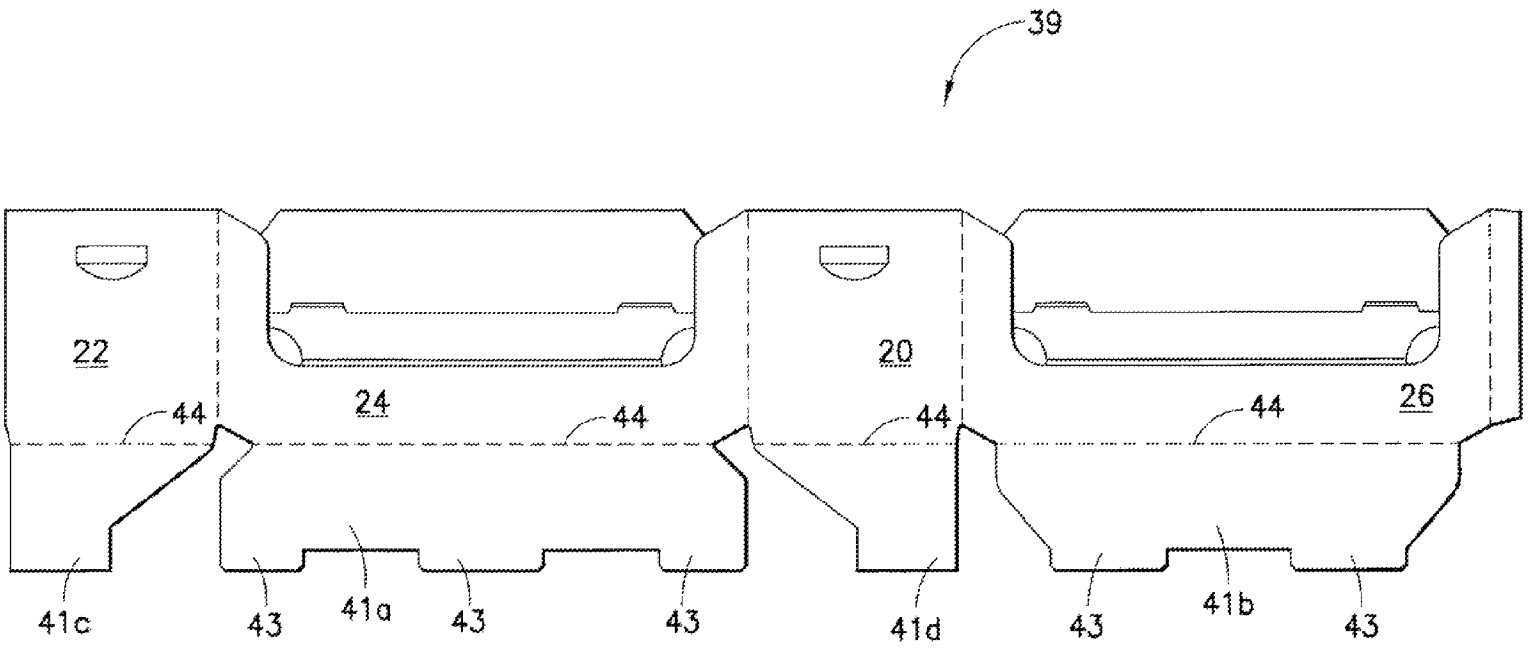

The bottom portion 19 may be formed as a single-piece or multi-piece construction such as by cooperating bottom panels 41*a*, 41*b*, 41*c*, 41*d*. Various configurations are possible. By way of non-limiting example, the bottom panels 41*a*, 41*b* may be formed as part of one of the blanks 36, 38, such as by extending from the first and second edge panels 24, 26, respectively, with the fold lines 44 being located therebetween. In addition, the bottom panels 41*c*, 41*d* may extend from the first and second end panels 20, 22, respectively, with the fold lines 44 being located therebetween. FIGS. 26 and 27 show possible blanks 37, 39 usable to form the box portion 14. The blanks 37, 39 include four cooperating bottom panels 41*a*, 41*b*, 41*c*, 41*d* for forming the bottom portion 19. The bottom panels 41*a*-41*d* may be configured in any known manner so as to cooperatively assemble to form the bottom portion 19. The bottom panels 41*a*-41*d* may be configured to partially or wholly interleave and/or overlap in being assembled, such as a four-flap HSC design (blank 39). Portions of the bottom panels 41*a*-41*d* may be connected along fold lines 44 (blank 37). In this manner, the bottom panels 41*a*-41*d* may be configured to assemble together to form the bottom panel 19 with assembly of the box portion 14. Although four of the bottom panels 41*a*-41*d* are shown, the bottom portion 19 may be formed by other quantities of the bottom panels.

The pieces making up the bottom portion 19, such as the bottom panels 41*a*-41*d*, may be fastened in an assembled state to provide rigidity to the bottom portion 19 and to the display container 10. The bottom panels 41*a*-41*d* may be fastened in an assembled state in any manner including, but not limited to, by gluing, taping and/or stapling. The fastening may be manually and/or automatedly conducted. Alternatively, an overlapped and/or interleaved state of the bottom panels 41*a*-41*d* may be relied upon for maintaining for the bottom panels 41*a*-41*d* in the assembled state without additional fastening.

Figure 16:
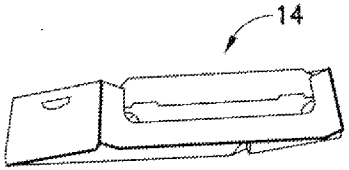
Figure 17:
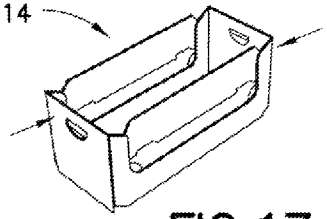
Figure 20:
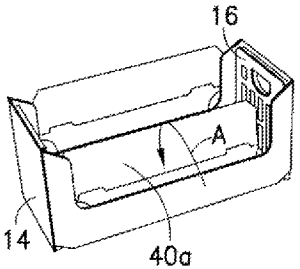

With reference to FIGS. 15-22, with the bottom panel 19, the display container 10 is assembled in similar fashion to that described above. During assembly, it is preferred that in forming the box portion 14, the bottom panel 19 is caused to be assembled. For example, as shown in FIGS. 15-17, the blank 37 is prepared and adjusted to provide the box portion 14 with a rectangular shape. As shown in FIG. 15, with the box portion 14 having a rectangular shape, the bottom panels 41*a*, 41*b* preferably have fingers 43 formed to interleave to form the bottom portion 19. Preferably, adhesive is provided (such as pressure sensitive adhesive) to adhere the bottom panels 41*a*-41*d* in the assembled state.

Figure 8:
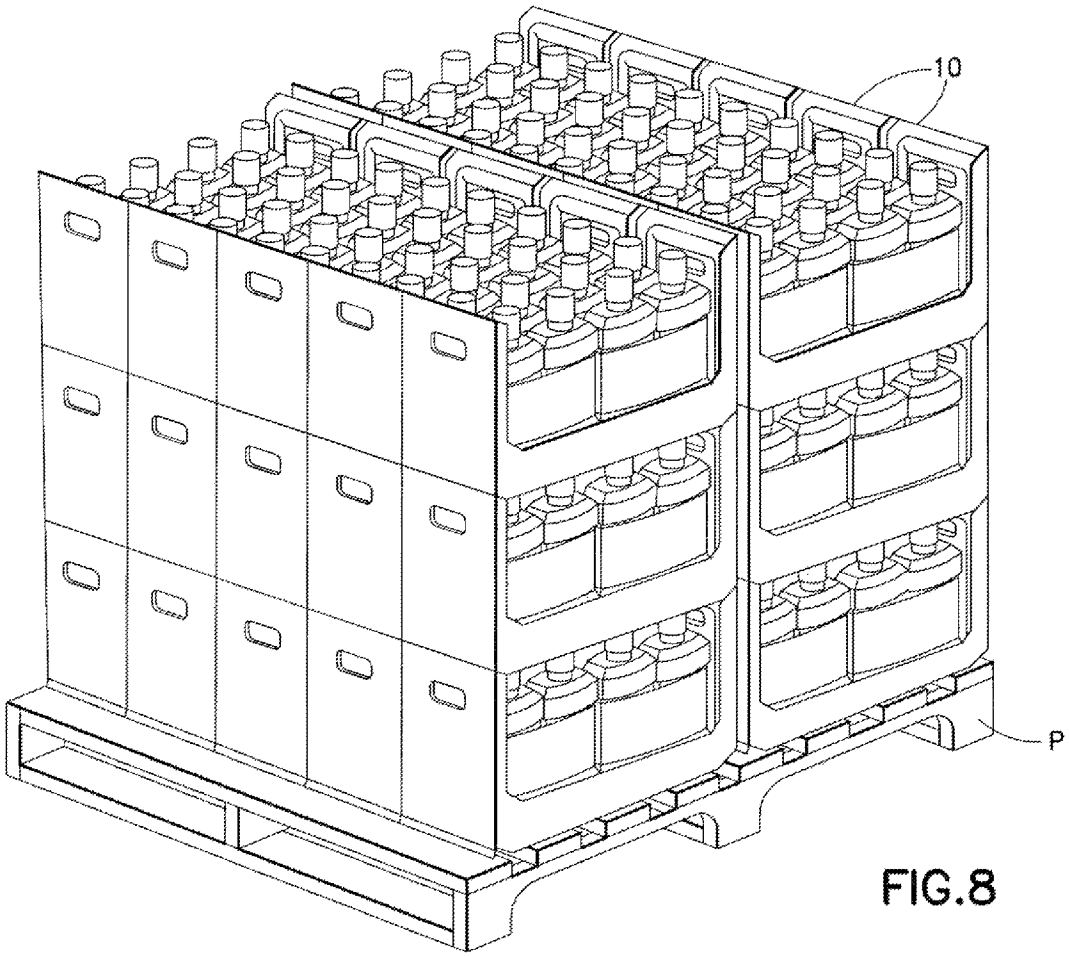
FIG. 8 shows a pallet packed with display containers formed in accordance with the subject invention.
Figure 9:
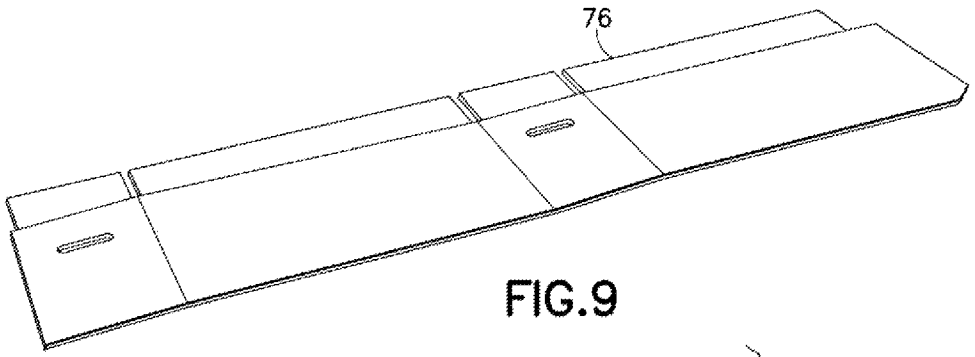
FIGS. 9-13 show a shipping carton embodiment of the subject invention.
Figure 10:
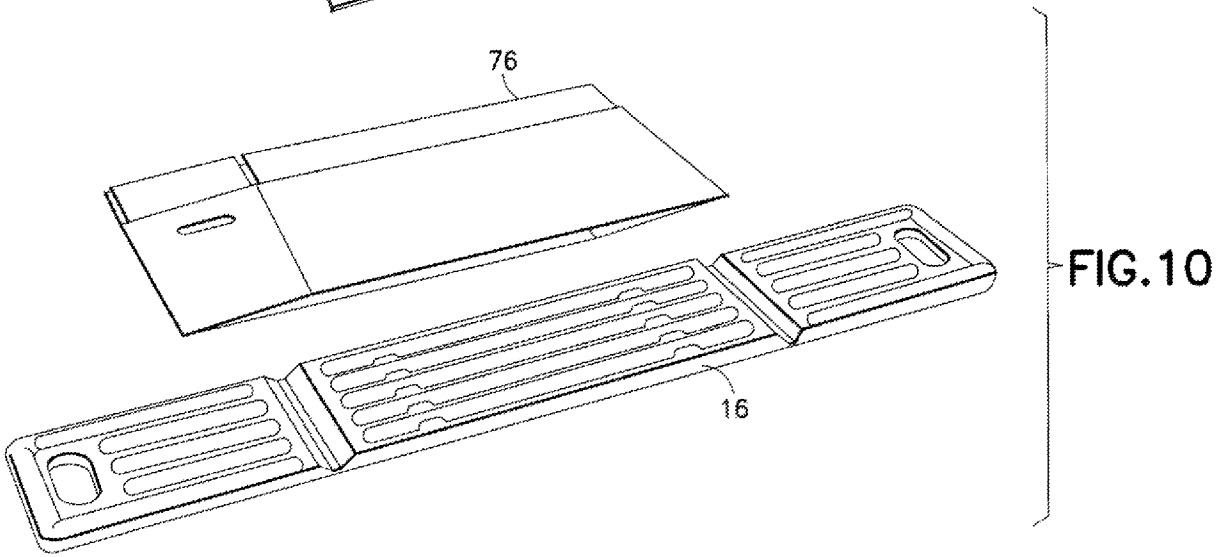
Figure 11:
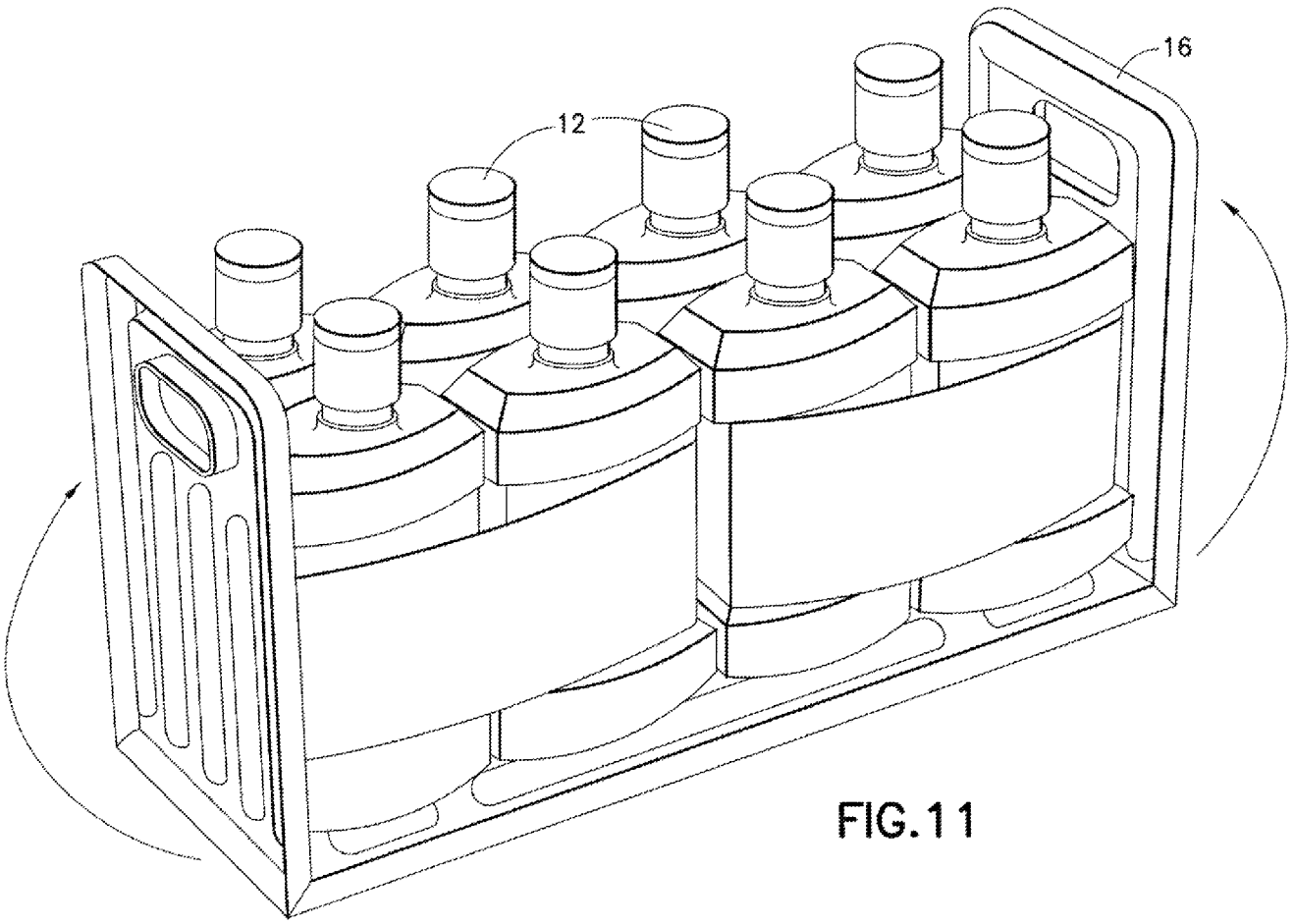
Figure 12:
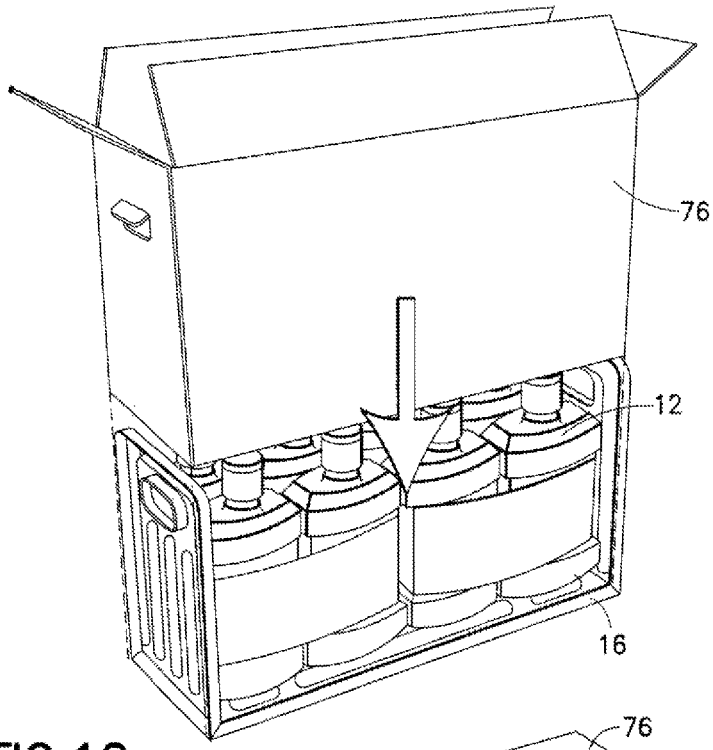
Figure 13:
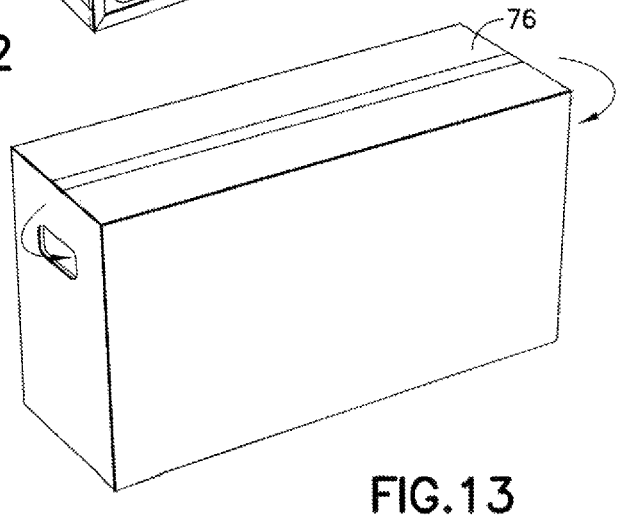
Figure 14:
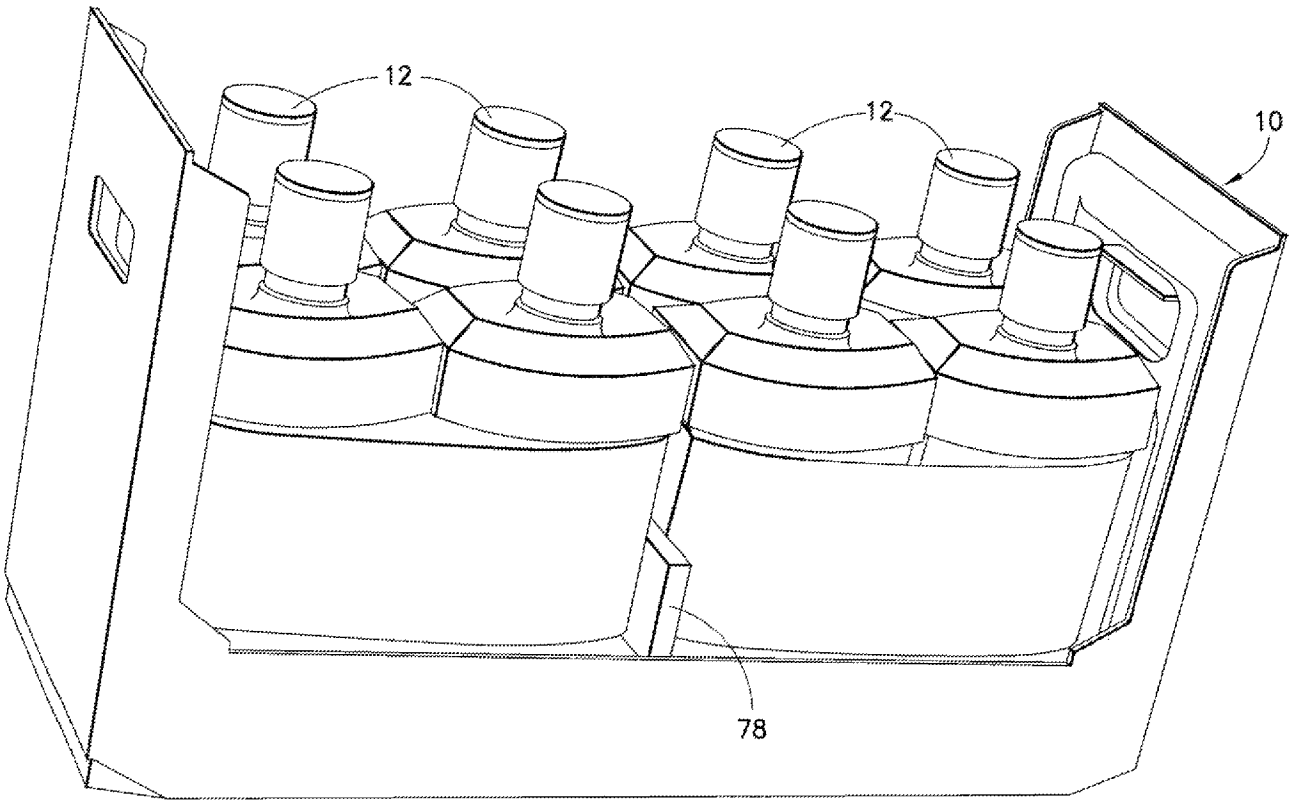
FIG. 14 shows a display container formed in accordance with the subject invention having a divider.

With reference to FIG. 7, as an additional feature, the display container 10 may have improved stacking features. Cut-outs 70 may be formed in the box portion 14 adjacent to one or more bottom corners 72 (FIG. 1). Correspondingly, one or more strips 74 may be disposed adjacent to the first and/or second end panels 20, 22 which terminate with a complementary shape formed to mate with the cut-outs 70 with the display container 10 being stacked with a second of the display containers 10. Thus, for example, as shown in FIG. 7, the cut-outs 70 may have triangular shapes, with the strips 74 terminating with the same shape. It is further preferred that the top of the display container 10 be maintained open so that the reinforcing layers 16 of the display containers 10 may be stacked atop the reinforcing layers 16 of similarly formed display containers 10. The stacked arrangement of the reinforcing layers 16 provides stable resting surfaces. The interengagement of the cut-outs 70 and the strip 74 further provides stability to the stacked configuration. As shown in FIG. 8, relatively large stacks may be formed for shipping (e.g., atop pallet P) and/or display at point-of-sale. The blank 38 includes the cut-outs 70 and the correspondingly shaped strips 74. In addition, as discussed above, the first and second end panels 20, 22 may be formed with slightly greater height than the corresponding second and third panels 58, 60. Thus, the first and second end panels 20, 22 may be configured to overlap a portion of an upper stacked display container 10 in providing additional interengagement and stackability. The upper stacked display container 10 is thus partially nested within the lower stacked display container 10, particularly between the first and second end panels 20, 22.

Figure 28:
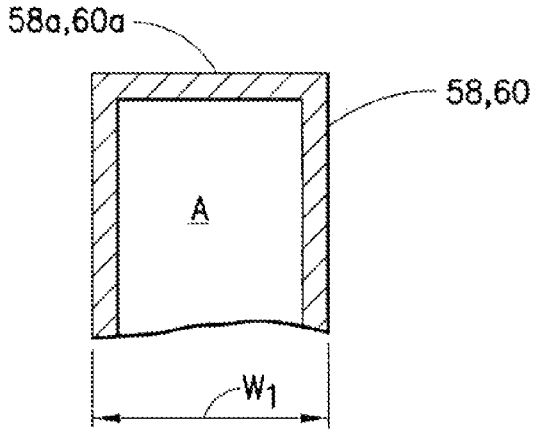
FIG. 28 shows a configuration of the second and/or third panel of the reinforcing layer.
Figure 39:
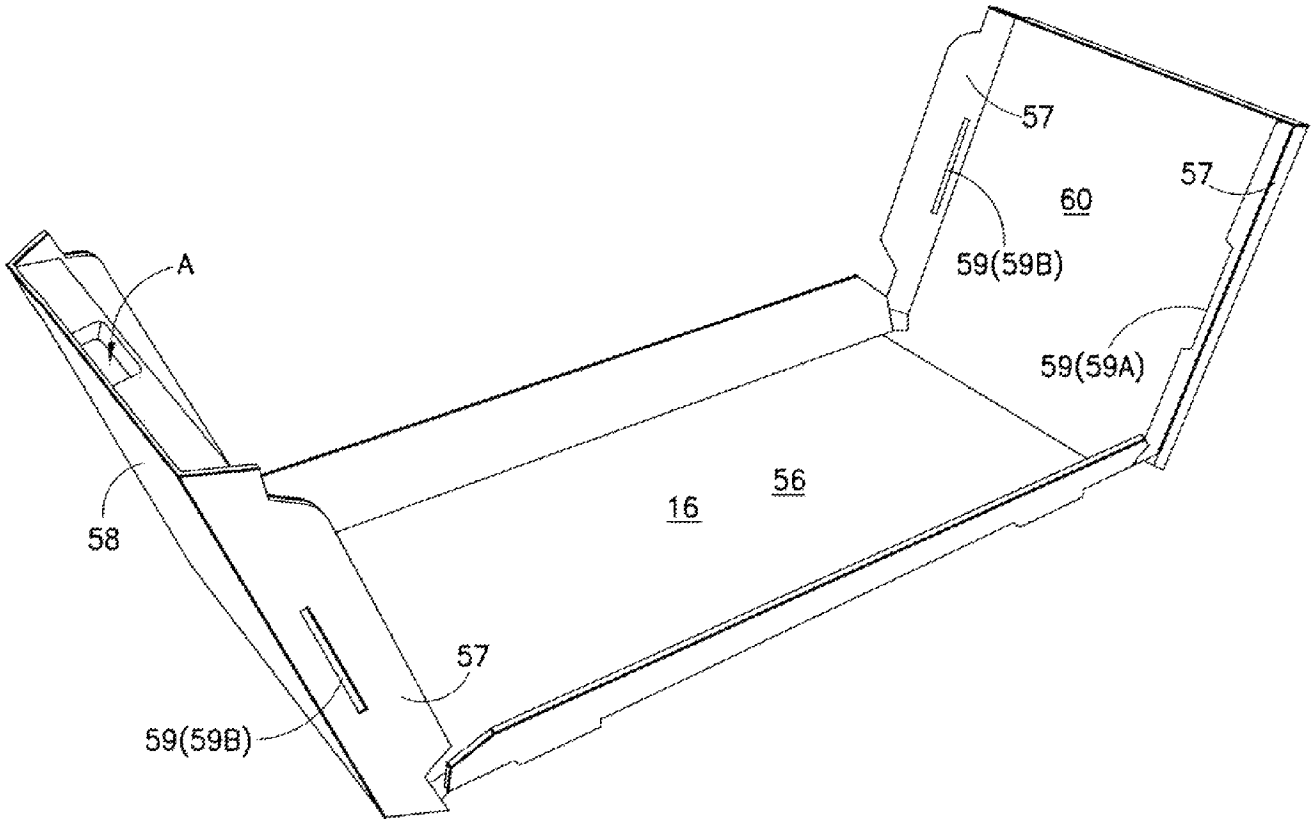
Figure 40:
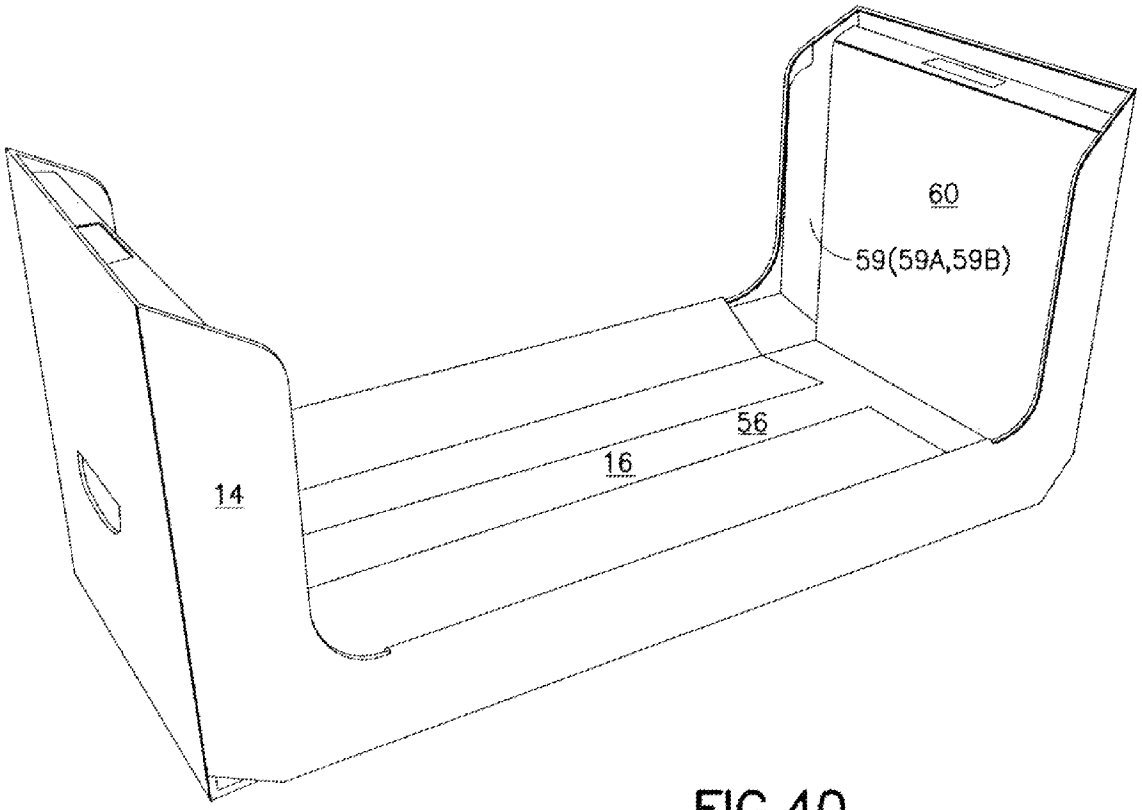
Figure 41:
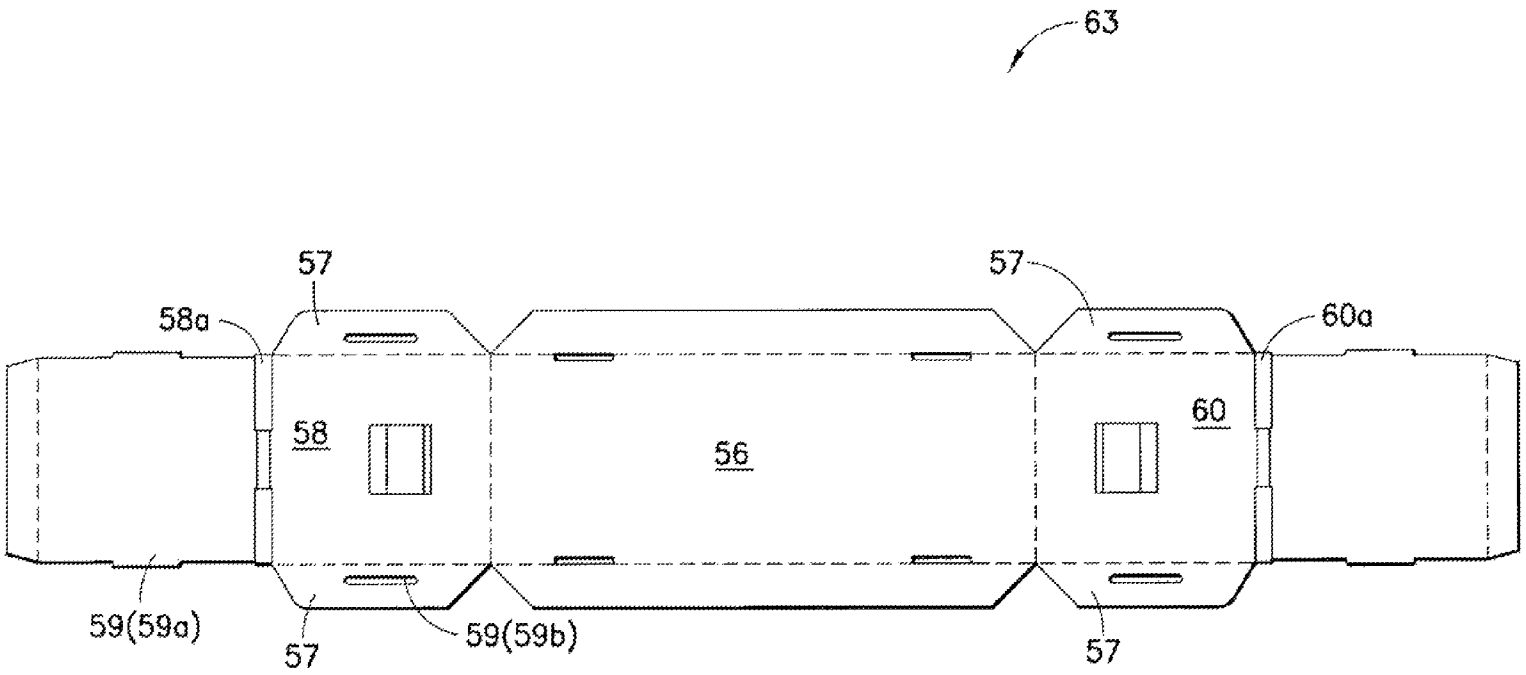

It is also preferred that the second and third panels 58, 60 each have an exposed upper edge 58*a*, 60*a*, respectively, (FIG. 18) which is of sufficient thickness to provide stable support for an upper stacked display container 10. The upper edges 58*a*, 60*a* provide the support for the upper stacked display container 10. Preferably, the upper edges 58*a*, 60*a* are generally flat and formed with a thickness $w_1$ which is at least 0.375 inches, more preferably at least 0.5 inches. The thickness $w_1$ provides sufficiently large resting surfaces for an upper stacked display container 10 to maintain such in a stable stacked relationship. The upper edges 58*a*, 60*a* may be defined by the edges of the second and third panels 58, 60, respectively, where the thickness $w_1$ equals the thickness of the second and third panels 58, 60, respectively. Alternatively, the second panel 58 and/or the third panel 60 may be folded or otherwise configured to define the thickness $w_1$ greater than the thickness of the respective second or third panel 58, 60. For example, with reference to FIG. 28, the second or third panel 58, 60 may be in a folded configuration with or without an airspace A being trapped therewithin. In addition, with reference to FIGS. 39-41, one or more edge flaps 57 may be provided on the second panel 58 and/or the third panel 60 formed to cover the airspace A wholly or partially. Cooperating locking elements 59, such as tongue 59A and groove 59B, may be formed on the second panel 58 and/or the third panel 60 to provide rigidity in the folded condition. The cooperating locking elements 59 may be also provided where the airspace A is not provided, but the second or third panel 58, 60 is of multi-wall construction. FIG. 41 shows a blank 63 which may be used to form the reinforcing layer with the edge flaps 57 and the cooperating locking elements 59.

As will be appreciated by those skilled in the art, the display container 10 of the subject invention not only provides increased strength over prior art display containers, but also improves load bearing for stacking purposes. The display container 10 may be packaged by a vendor and shipped to a retailer, where the retailer places the display container 10 at point-of-sale without un-packing the display container 10. Due to the construction of the container 10, savings in costs of materials may be achieved without loss of load-bearing strength. Also, the container 10 may be relatively easily assembled as compared to prior art display containers, thus resulting in costs of labor. The display container 10 is also sufficiently strong and stable in stacking to avoid the use of slip-sheeting between units and to avoid the use of fillers or other additional packaging components used in the prior art.

As an additional feature, as shown in FIG. 6, a shipping carton 76 may be provided formed to telescope over the display container 10. The shipping carton 76 may be formed to generally the same footprint dimensions of the display container 10. The shipping carton 76 may be formed of paperboard and provide an outer protective shell during shipping. The shipping container 76 may be taped to the display container 10 so as to be retained therewith during shipping.

With reference to FIGS. 9-13, the shipping carton 76 may be used directly with the reinforcing layer 16, optionally without the box portion 14.

Figure 29:
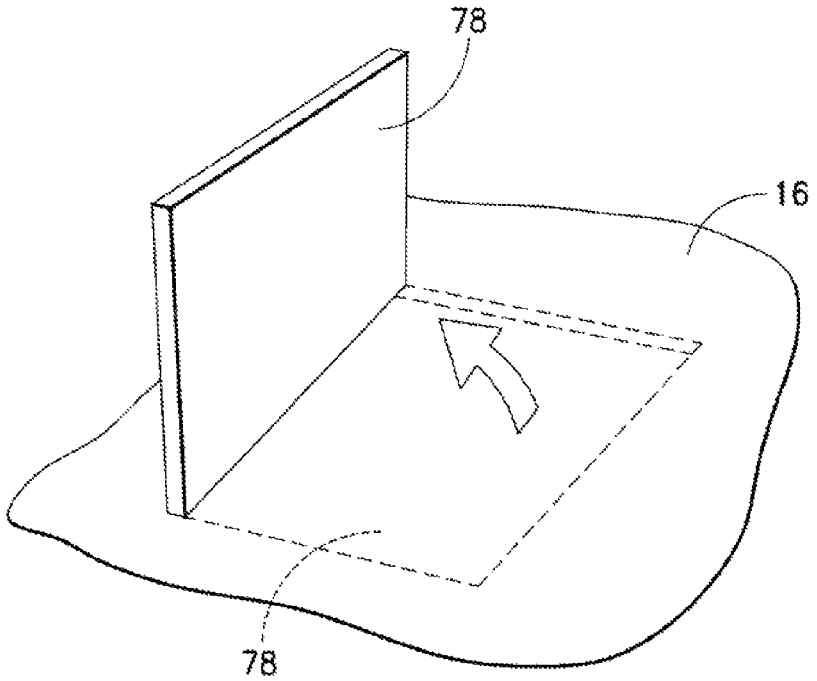
FIG. 29 shows a configuration for a divider usable with the subject invention.
Figure 42:
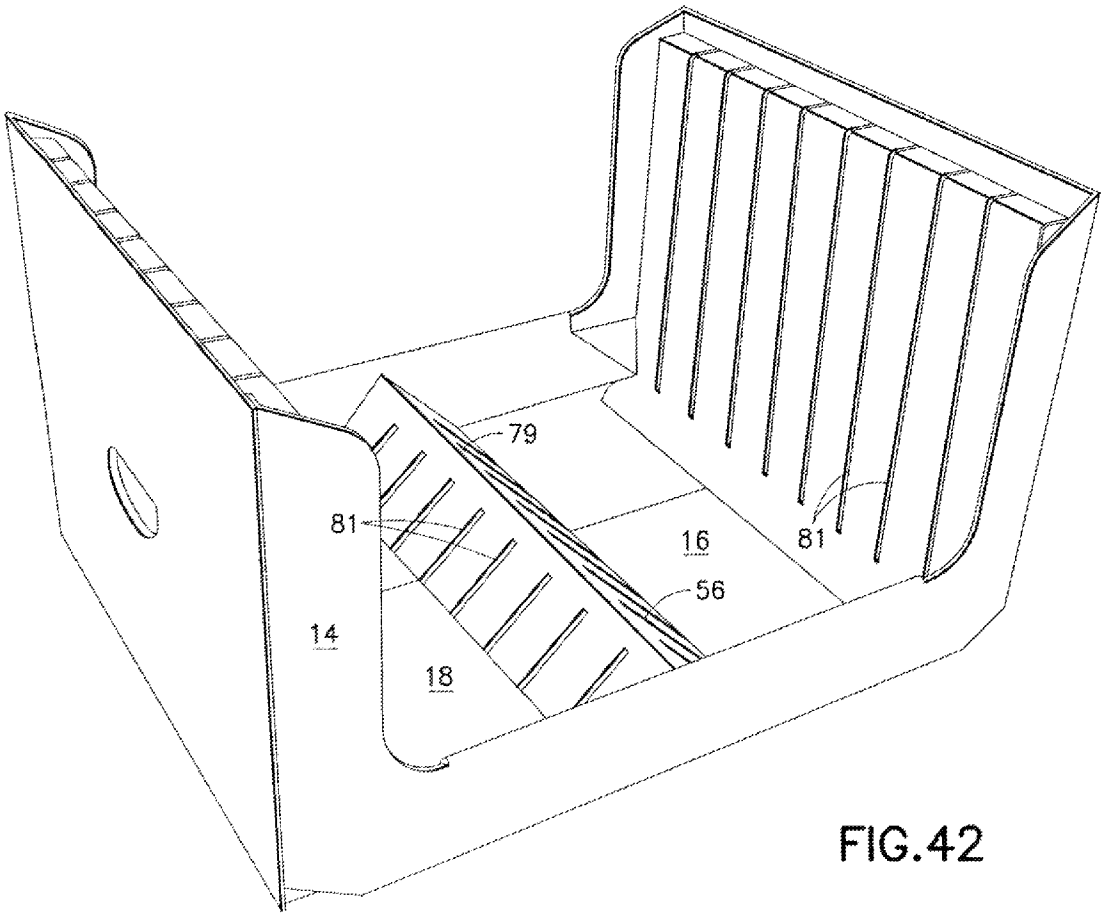
Figure 43:
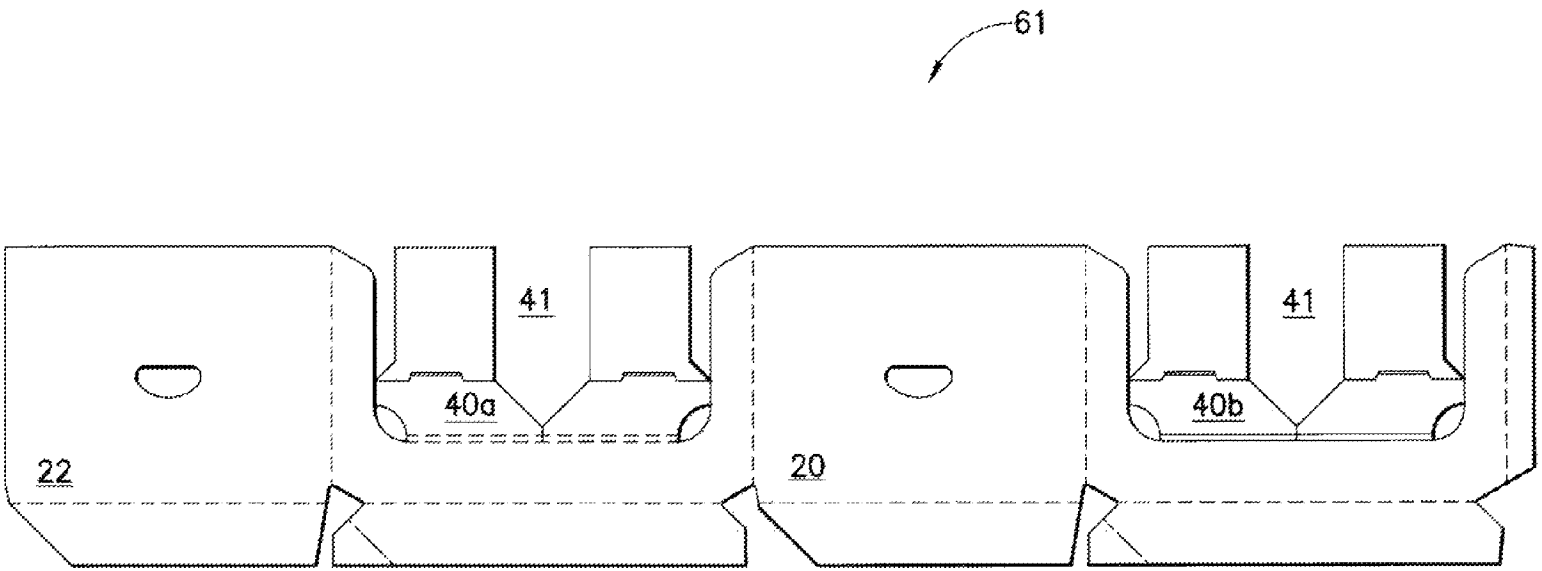
Figure 44:
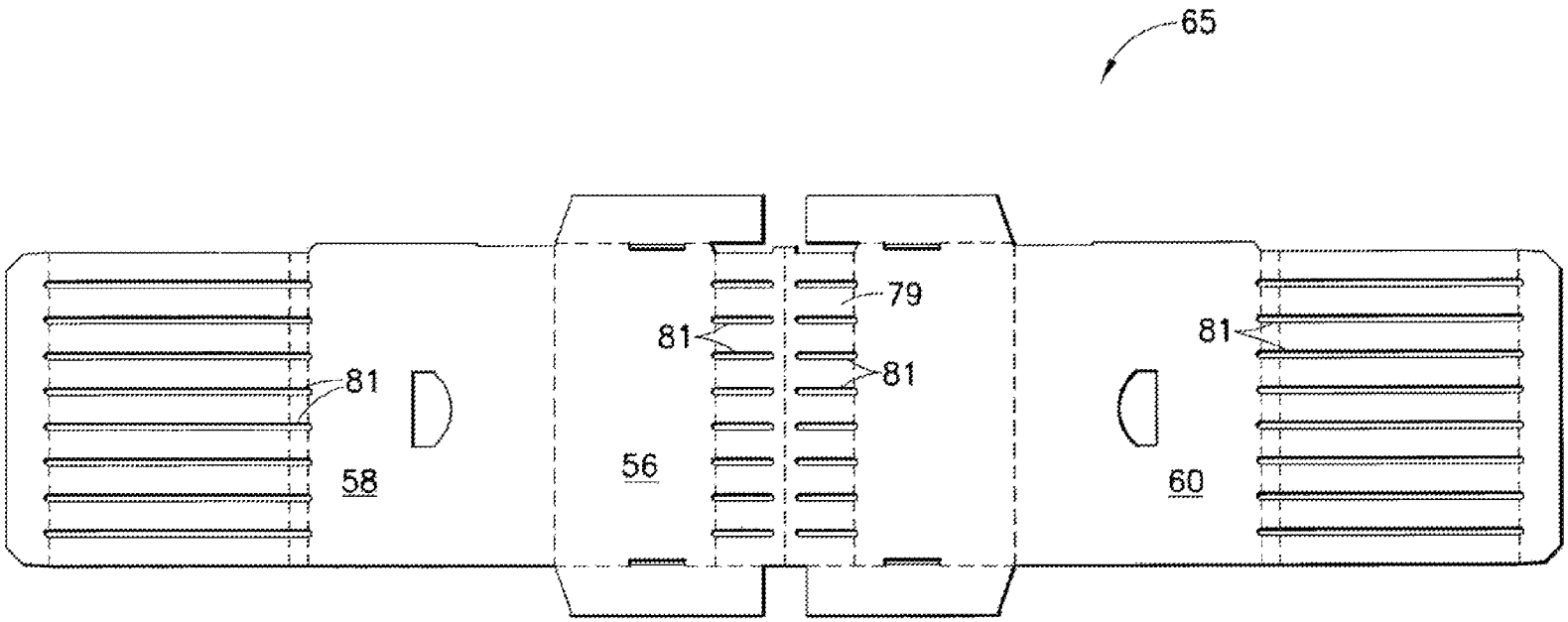

In addition, as shown in FIGS. 14 and 23-25, one or more dividers 78 may be provided to separate the interior of the display container 10 into one or more compartments, e.g., to separate the product 12. The dividers 78 may be of any known type, such as, T-dividers, U-dividers, and box dividers. The dividers 78 may be unitarily formed with the box portion 14 and/or the reinforcing layer 16 and/or formed separately. For example, with reference to FIG. 29, in the reinforcing layer 16, e.g., at the first panel 56, one or more dividers 78 may be die-cut, or otherwise defined therein, which can be popped-up or otherwise adjusted to a use position. The dividers 78 may be likewise formed in the box portion 14. Where separately formed, the dividers 78 may be fastened to the box portion 14 and/or the reinforcing layer 16. In addition, portions of the box portion 14 and/or the reinforcing layer 16 may be formed to extend upright 80 as to act as a divider or holder. With reference to FIGS. 42-44, the reinforcing layer 16 may be provided with at least one raised ridge 79 which may act as a divider. Retention slots 81 may be formed in the raised ridge 79 for releasably retaining product, such as blister-card packaged product. The at least one raised ridge 79 may be formed to extend through the base portion 18 with the first panel 56 being generally located below the base portion 18. As shown in FIG. 42, in addition to the first panel 56, the retention slots 81 can be optionally formed in other portions of the reinforcing layer 16, such as the second and/or third panels 58, 60. A blank 61 for forming the box portion 14 and a blank 65 for forming the reinforcing layer 16 are shown in FIGS. 43-44, respectively, as non-limiting illustrative examples of possible blanks usable with the subject invention. Cooperating base panels 40*a*, 40*b* may be used to form the base portion 18 with a space 41 being defined to accommodate each of the raised ridges 79.

Figure 24:
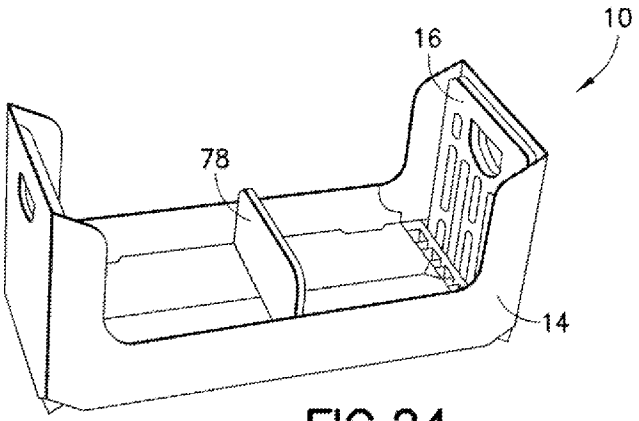
FIGS. 23-25 show different dividers usable with the subject invention.
Figure 25:
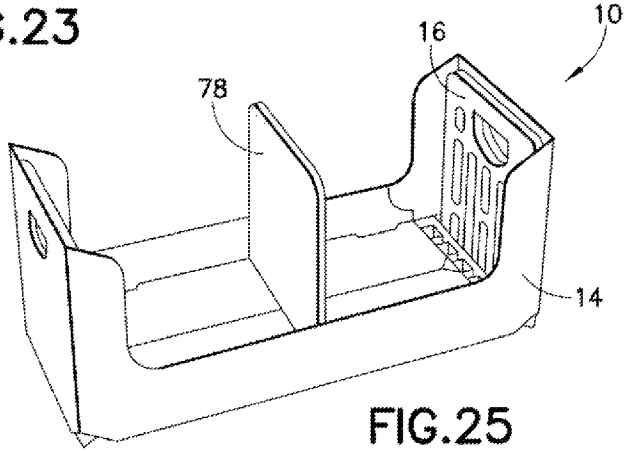
Figure 23:
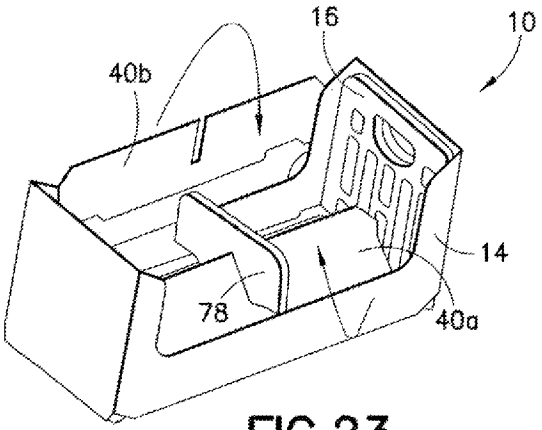
Figure 46:
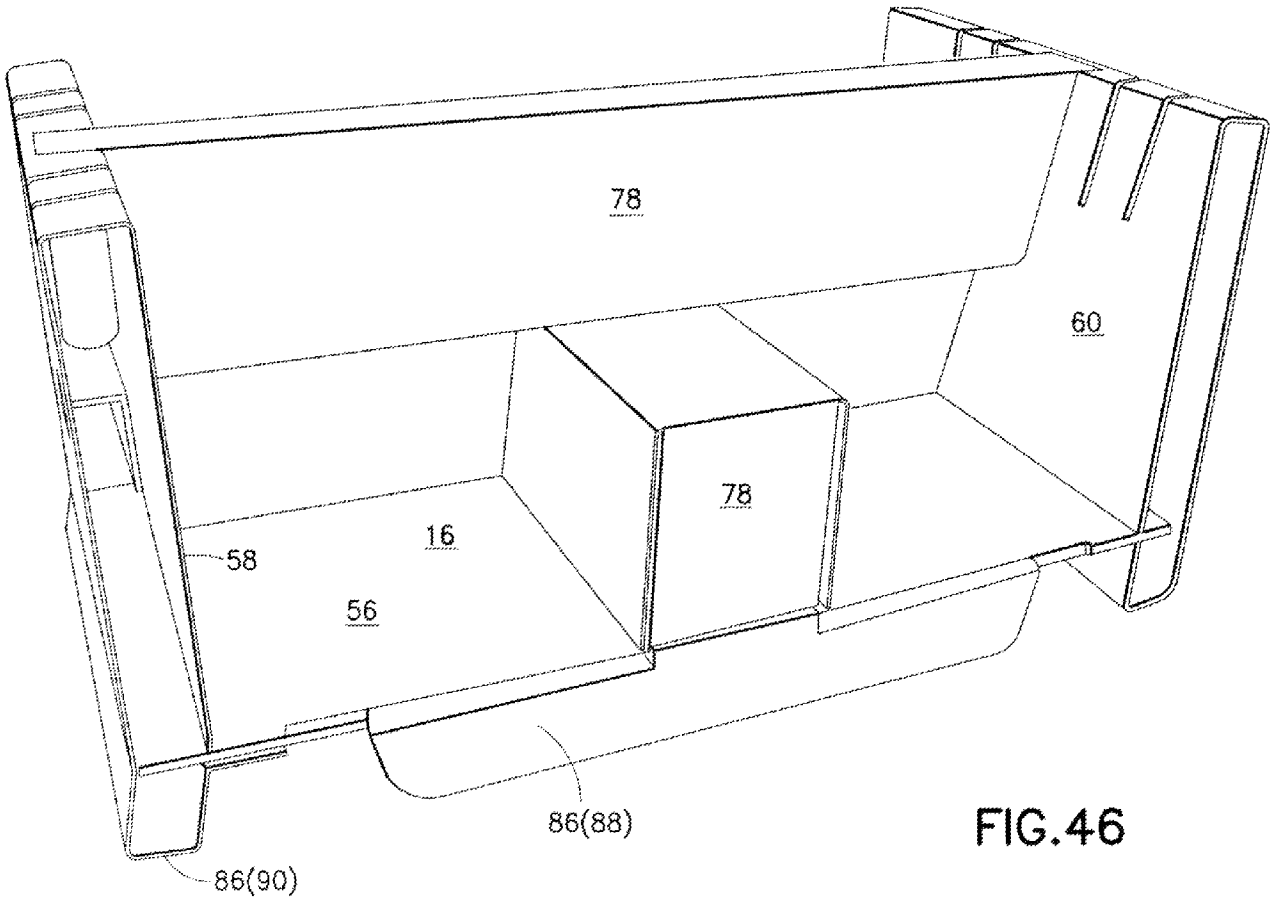
FIGS. 46-48 show a raised first panel configuration usable with the subject invention.

The dividers 78 may be used to stabilize the product 12; separate the product 12 (such as by type (e.g., by SKU number)); and/or, when extended upward, assist in load-bearing in a stacked configuration. The dividers 78 may be formed of different heights as shown in FIGS. 24, 25 and 46.

Any of the features described herein may be used in any combination. For example, the dividers 78 may be used with the reinforcing layer 16 in the embodiment shown in FIGS. 9-13.

Figure 30:
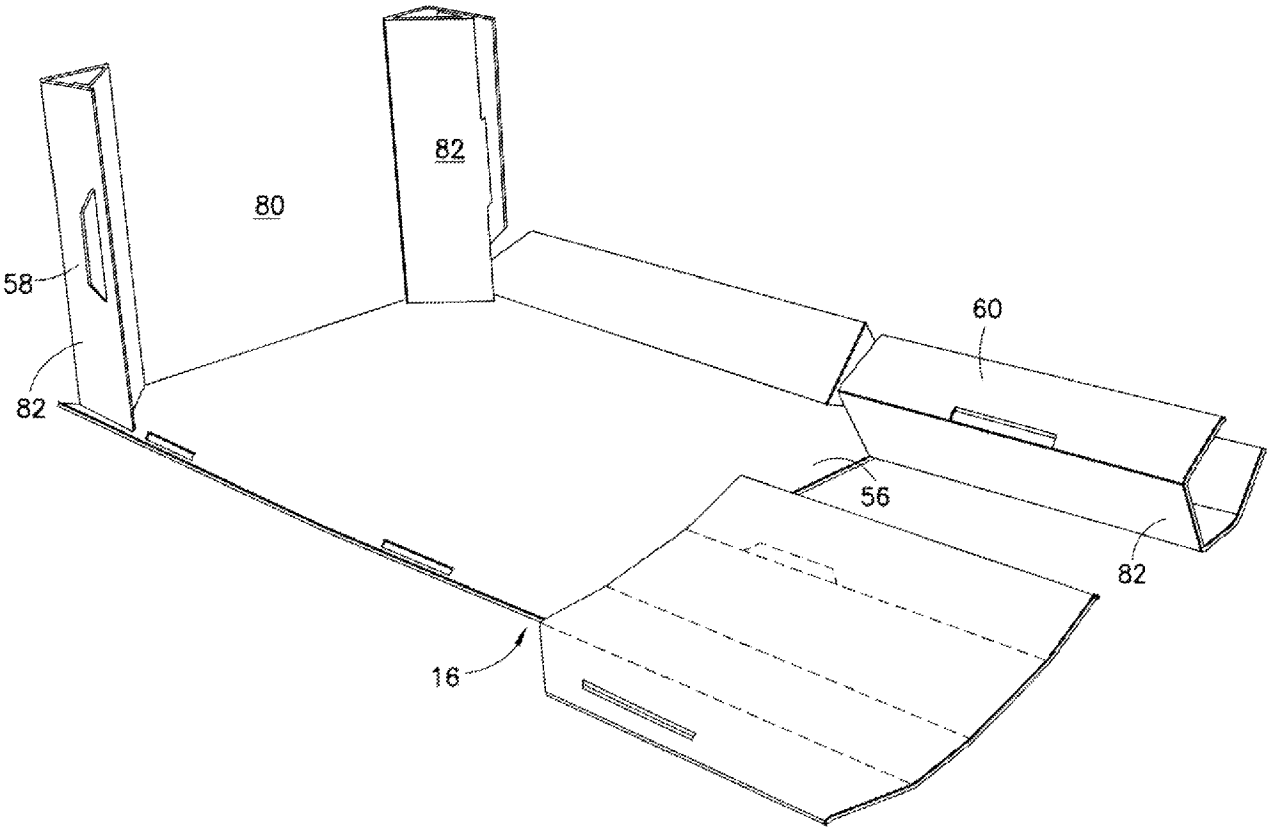
FIGS. 30-45 show variations of the reinforcing layer usable with the subject invention.
Figure 31A:
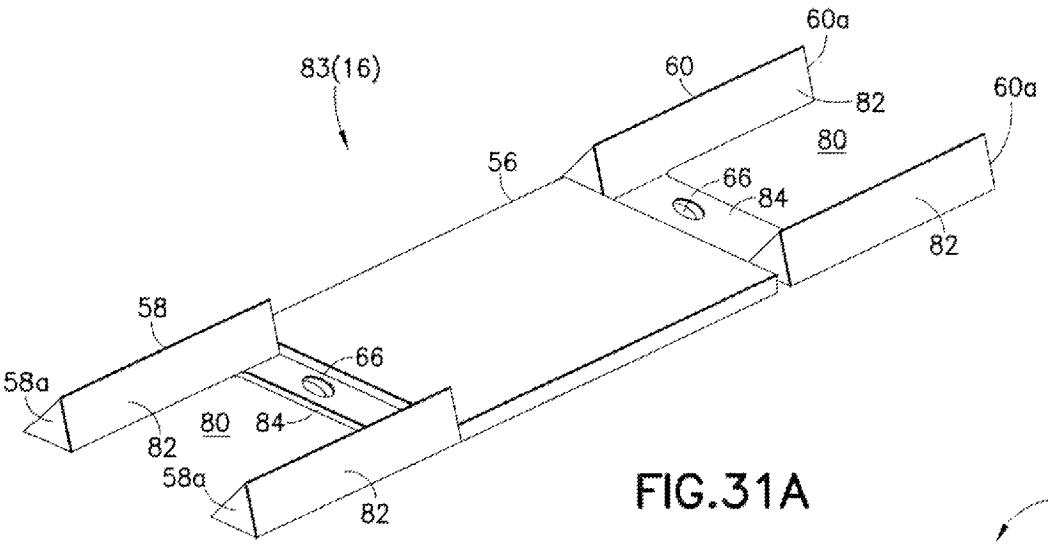
Figure 31B:
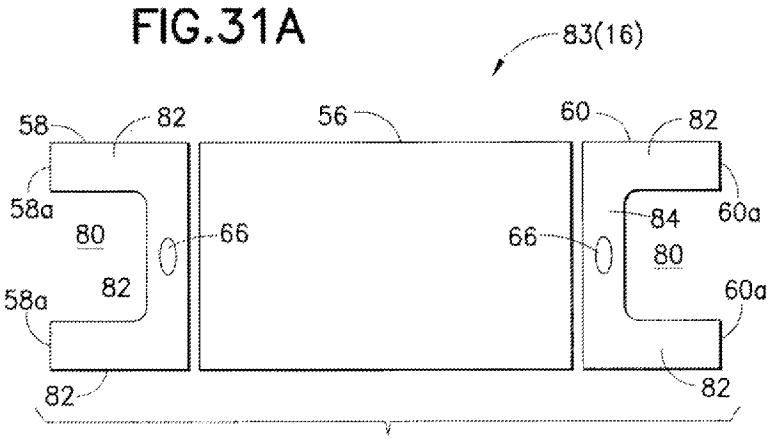
Figure 32:
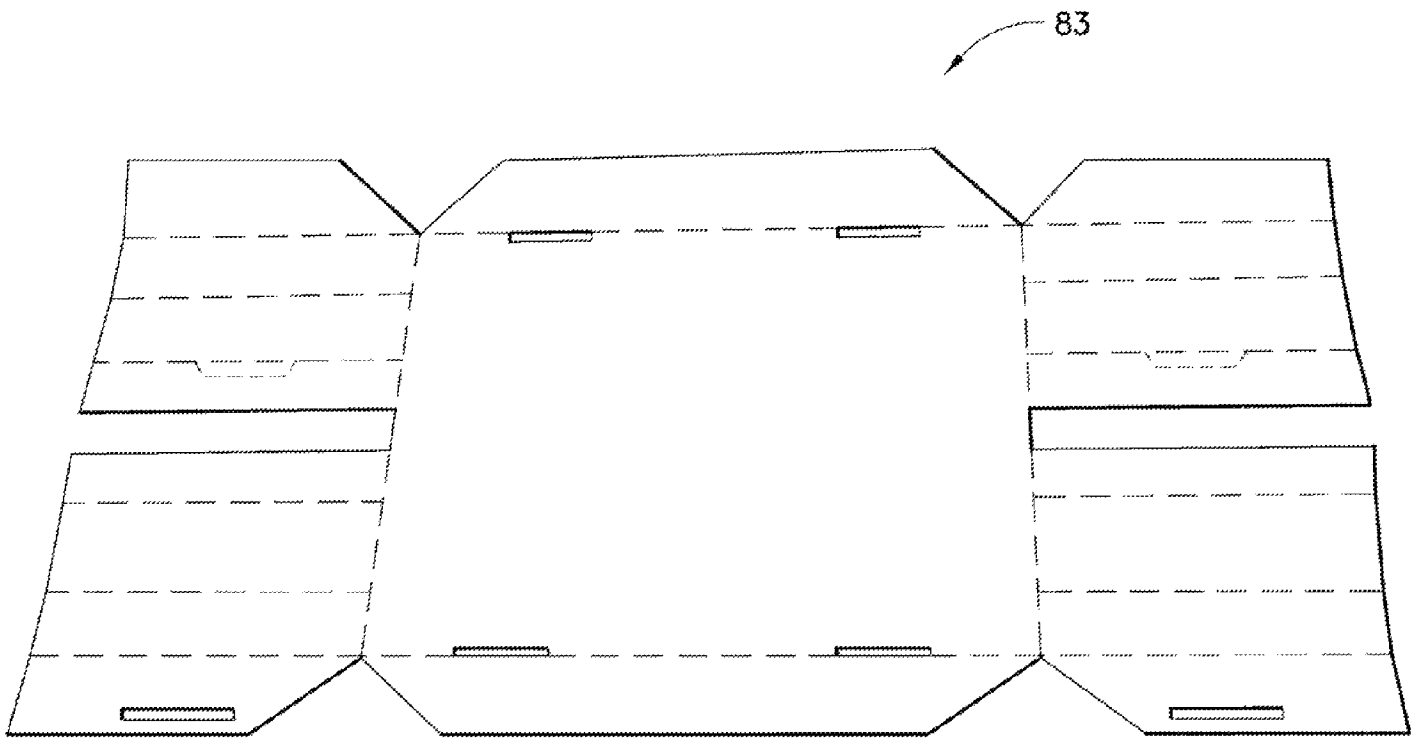

The reinforcing layer 16 may be formed with one or more windows 80 being defined in the second panel 58 and/or the third panel 60. As shown in FIGS. 30-38, the second panel 58 and/or third panel 60 may be formed with posts 82. The posts 82 may bound the windows 80 and, thus, define portions thereof. The reinforcing layer 16, with the posts 82, may be formed of any of the materials described above for forming the reinforcing layer 16, including molded pulp, paperboard, thermoplastic, wood, metal or combinations thereof. As shown in FIGS. 30-32, the reinforcing layer 16 may be formed from a single blank 83, e.g., formed of paperboard (FIGS. 30 and 32), or formed of molded pulp (FIGS. 31A and 31B).

Figure 45:
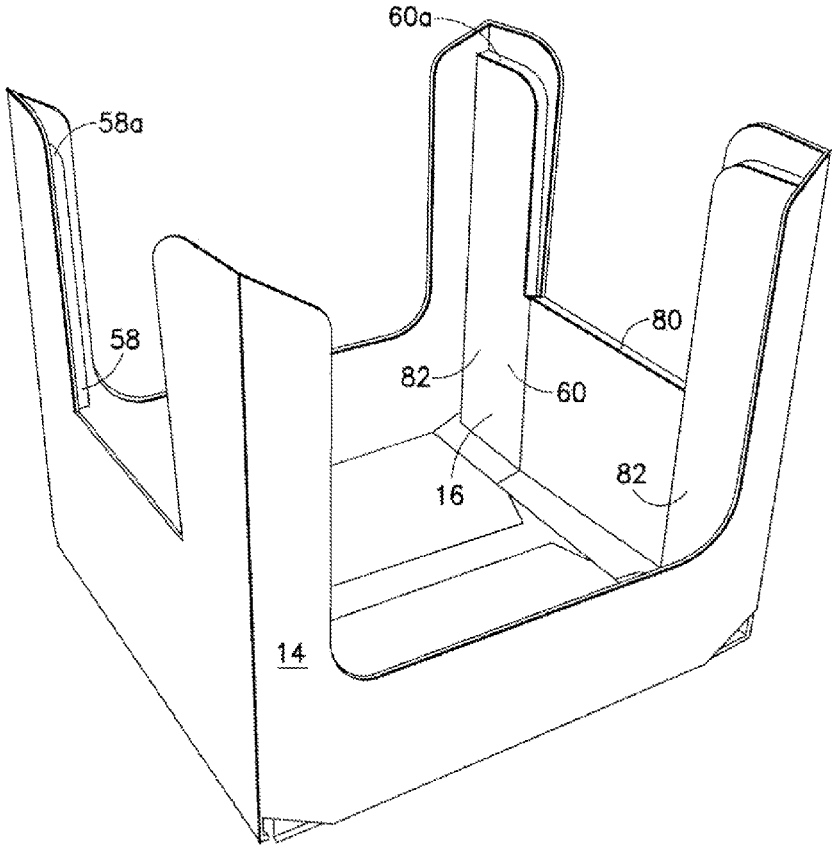

Preferably, the posts 82 define the upper edges 58*a*, 60*a*. The posts 82 may be positioned to support an upper-stacked display container 10 in a stacked configuration. As shown in FIGS. 30-38, the posts 80, 82 may have polygonal cross-sections, e.g., triangular, to provide sufficient area for supporting the upper-stacked displayer container 10. With reference to FIG. 45, the posts 80, 82 may be defined by thickened or multi-wall constructions to define the upper edges 58*a*, 60*a*.

The second panel 58 and/or the third panel 60 may have a cross-piece 84 extending between the posts 82. The cross-pieces 84 may be of lower height than the posts 82 to define lower edges of the windows 80. The secondary hand holes 66 may be formed in the cross-pieces 84 and the reinforcing layer 16 may be fixed to the box portion 14 as described above.

Alternatively, the second panel 58 and/or the third panel 60 may be defined by only the posts 82, without the cross-piece 84. Here, the reinforcing layer 16 may be located in the box portion 14 and need not be fixed thereto. The reinforcing layer 16 may be unfixedly seated in the box 14. The reinforcing layer 16 may be fastened to the box portion 14, e.g., by adhesive, stapling, and so forth. With this arrangement, the second panel 58 and/or the third panel 60 are formed narrower than the corresponding first and/or second end panel 20, 22 (i.e., the post(s) 82 have narrower width than the corresponding first and/or second end panel 20, 22). As shown in FIG. 33, the first and/or second end panel 20, 22 may be formed with the secondary window 34 in at least proximal registration with the window 80 defined by the adjacent second or third panel 58, 60.

Figure 47:
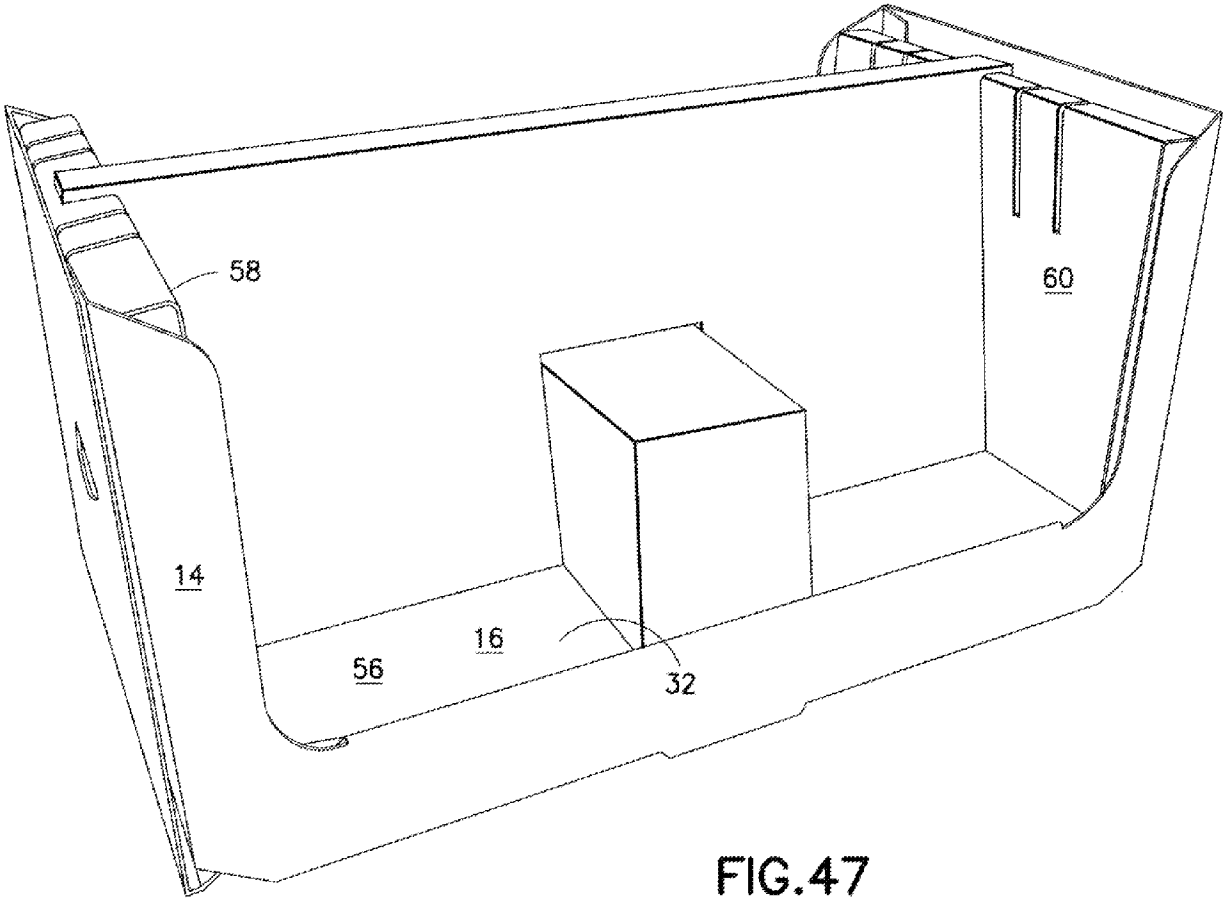
Figure 48:
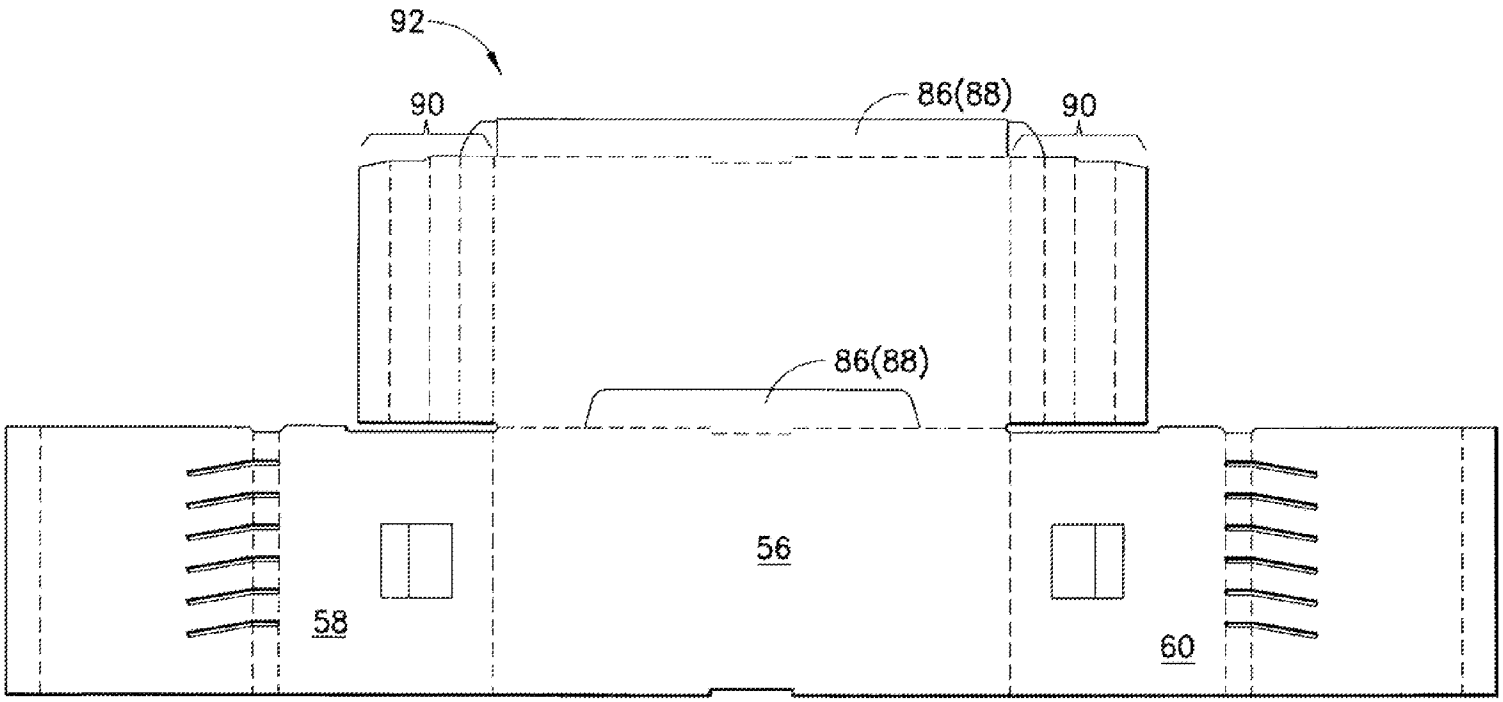

With reference to FIGS. 46-48, the base portion 18 may be spaced from the first panel 56. With the base portion 18 being below the first panel 56, and spaced therefrom, the first panel 56 may be positioned elevationally closer to the window 32 and/or the secondary window(s) 34. Advantageously, this allows for better visual presentation of certain product. With greater elevational difference (i.e., the base portion 18 and/or the first panel 56 being located lower relative to the window 32 and/or the secondary window(s) 34), certain product may be partially or wholly obscured. To maintain stability in the spaced condition, one or more spacers 86 may extend from the base portion 18 and/or the first panel 56. The spacers 86 are configured to generally maintain constant spacing between the base portion 18 and the first panel 56, in all conditions, including a loaded condition. The spacers 86 may be panel shaped, such as panels 88, which provide edge support and/or folded supports 90 which provide area support. It is preferred that a plurality of the spacers 86 be provided, particularly spaced-apart to provide distributed support. The spacers 86 may be spaced apart along the perimeter of the base portion 18. Blank 92, in FIG. 48, illustrates a possible blank for forming the reinforcing layer 16.

What is claimed is:

1. A display container comprising:

a box portion having a base portion, an upstanding first end panel, an upstanding second end panel spaced from said first end panel, an upstanding first edge panel, and an upstanding second edge panel, said first edge panel located between said first end panel and said second end panel, said second edge panel located between said first end panel and said second end panel, wherein said first edge panel extends a lesser distance from said base portion than said first end panel and said second end panel; and, a reinforcing layer having a first panel disposed to at least partially overlap said base portion, a second panel disposed adjacent to said first end panel in face-to-face engagement, and a third panel disposed adjacent to said second end panel in face-to-face engagement, wherein said reinforcing layer is formed of a material stronger in shear than the material of said box portion, wherein said second panel includes a first panel portion and a second panel portion spaced from said first panel portion, said first panel portion and said second panel portion at least partially define a window therebetween, said window being open along a top edge between said first panel portion and said second panel portion.

2. A display container as in claim 1, wherein said box portion is unitarily formed.

3. A display container as in claim 1, wherein said reinforcing layer is unitarily formed.

4. A display container as in claim 1, wherein said second edge panel extends a lesser distance from said base portion than said first end panel and said second end panel.

5. A display container as in claim 1, wherein said reinforcing layer is formed of paperboard.

6. A display container as in claim 5, wherein said box portion is formed of paperboard.

7. A display container in as in claim 1, wherein said second panel being in a folded configuration.

8. A display container as in claim 7, wherein said third panel being in a folded configuration.

9. A display container comprising:

a box portion having a base portion, an upstanding first end panel, an upstanding second end panel spaced from said first end panel, said first end panel and said second end panel each terminating respectively in a free end, an upstanding first edge panel, and an upstanding second edge panel, said first edge panel located between said first end panel and said second end panel, said second edge panel located between said first end panel and said second end panel, wherein said first edge panel extends a lesser distance from said base portion than said first end panel and said second end panel; and, a reinforcing layer having a first panel disposed to at least partially overlap a portion of said base portion, a second panel disposed adjacent to said first end panel in face-to-face engagement, and a third panel disposed adjacent to said second end panel in face-to-face engagement, wherein portions of said first and second end panels, opposite respective said free ends, are cut out so as to define cut-outs configured to receive portions of a box portion of a lower-stacked display container.

10. A display container as in claim 9, wherein said cut-outs are complementarily shaped with the portions to be received of the box portion of the lower-stacked display container.

11. A display container as in claim 9, wherein said cut-outs expose portions of said reinforcing layer.

12. A display container as in claim 9, wherein said first end panel is formed to extend beyond said second panel, and said second end panel is formed to extend beyond said third panel.

13. A display container as in claim 9, wherein said second panel being in a folded configuration.

14. A display container as in claim 13, wherein said third panel being in a folded configuration.

15. A display container as in claim 9, wherein said second panel includes a first panel portion and a second panel portion spaced from said first panel portion, said first panel portion and said second panel portion at least partially define a window therebetween.

16. A display container as in claim 15, wherein said window being open along a top edge between said first and second spaced-apart panel portions.

* * * * *